US006578367B1

(12) United States Patent
Schaefer et al.

(10) Patent No.: US 6,578,367 B1
(45) Date of Patent: Jun. 17, 2003

(54) LIQUID NITROGEN COOLING SYSTEM

(75) Inventors: John W. Schaefer, Wilmington, DE (US); Mark Heyman, Mays Landing, NJ (US)

(73) Assignee: TA Instruments-Waters LLC, New Castle, DE (US)

( * ) Notice: Subject to any disclaimer, the term of this patent is extended or adjusted under 35 U.S.C. 154(b) by 0 days.

(21) Appl. No.: 09/796,800

(22) Filed: Mar. 2, 2001

(51) Int. Cl.[7] ..... F25B 19/00
(52) U.S. Cl. ..... 62/51.1
(58) Field of Search ..... 62/51.1, 190, 216, 62/217, 218, 220, 527

(56) References Cited

U.S. PATENT DOCUMENTS

| | | | | |
|---|---|---|---|---|
| 3,828,567 A | * | 8/1974 | Lesczynski | 62/160 |
| 4,408,464 A | | 10/1983 | Salour et al. | |
| 5,172,558 A | | 12/1992 | Wassibauer et al. | |
| 5,207,068 A | | 5/1993 | Bridden | |
| 5,417,073 A | | 5/1995 | James et al. | |
| 5,421,171 A | | 6/1995 | Wardle | |
| 6,021,845 A | | 2/2000 | Hill et al. | |
| 6,070,414 A | | 6/2000 | Ross et al. | |
| 6,164,078 A | | 12/2000 | Lak et al. | |
| 6,167,947 B1 | | 1/2001 | Hokanson et al. | |
| 6,341,615 B1 | * | 1/2002 | Zorich et al. | 137/14 |

OTHER PUBLICATIONS

TA Instruments Liquid Nitrogen Cooling Acessory, Operator's Manual, Nov. 1999.
TA Instruments Liquid Nitrogen Cooling AcessoryCE, Operator's Manual, Nov. 1999.

* cited by examiner

*Primary Examiner*—William C. Doerrler
*Assistant Examiner*—Malik N. Drake
(74) *Attorney, Agent, or Firm*—Shaw Pittman LLP

(57) ABSTRACT

A liquid nitrogen cooling assembly incorporating a liquid detector which feeds back to control the nitrogen supply is disclosed. A pressure-controlled nitrogen source (e.g., a dewar) feeds liquid nitrogen to a heat exchanger mounted to a differential scanning calorimetry (DSC) cell. The DSC cell is cooled as liquid nitrogen in the heat exchanger contacting the cell is vaporized into nitrogen gas. The exhaust (nitrogen gas and, occasionally, nitrogen liquid) is fed to a liquid detection/evaporator assembly. If liquid nitrogen is detected in the exhaust by the liquid detection/evaporator assembly, an indication is fed back using a liquid detection feedback loop to a pressure control device. The pressure control device reduces the amount of pressure on the nitrogen source in order to eliminate liquid in the exhaust. When there is liquid in the exhaust, the liquid detection/evaporator assembly also collects and vaporizes the exhaust liquid so that it can be properly vented to atmosphere in gas form. When liquid is no longer detected in the exhaust, the pressure control device increases the pressure on the liquid nitrogen source until liquid is detected in the exhaust. Subsequent cycles control pressure in this manner to keep the heat exchanger full of liquid nitrogen.

67 Claims, 30 Drawing Sheets

LIQUID NITROGEN COOLING SYSTEM

FIELD OF THE INVENTION

The present invention relates to cooling apparatus and, particularly, to a cooling apparatus in which liquified gas is introduced into a chamber and cold vapor is extracted from the chamber.

BACKGROUND OF THE INVENTION

Differential thermal analysis (DTA) generally refers to a calorimetric technique for measuring physical properties of a substance by exposing the substance to different temperature regimes. DTA can be employed to measure parameters associated with phase transitions, glass transitions, polymerization/depolymerization, crystallization, softening, sublimation, dehydration, decomposition, oxidation, cure kinetics and so forth. A differential scanning calorimeter (DSC) measures temperatures and heat flows associated with energy-emitting or energy-absorbing (exothermic and endothermic, respectively) material transitions. DSCs are widely used in academic, government and private facilities for research purposes, as well as for quality control and production purposes.

Hereinafter, reference will be made to DSC, although it is to be understood to encompass DTA as well.

During DSC testing, the material being analyzed ("sample") is heated or cooled according to a desired temperature profile. The results, such as differential temperature or heat flow, are measured and analyzed to understand the properties of the sample material. The basic theory of DSC analysis is well understood; the reader is referred to Reading, et al., U.S. Pat. No. 5,224,775 (the '775 patent) and U.S. Pat. No. 3,456,490 (the '490 patent) for details on the theory of operation of exemplary DSC systems. The '775 and '490 patents are herein incorporated by reference in their entirety.

There are also other well-known thermal analysis techniques, such as Pressure Differential Scanning Calorimetry (PDSC), Pressure Differential Thermal Analysis (PDTA), and Differential Photocalorimetry (DPC). The invention described hereafter may also be applied to such instruments.

Typical DSC instrumentation includes the following basic components: a heated measurement chamber enclosing a sensor assembly upon which the material to be analyzed is placed; a furnace heater for heating the measurement chamber; and a cooling device for cooling the measurement chamber.

The cooling device may find application when temperature is being increased or decreased. When temperature is being increased, the cooling device may act as a heat sink for the furnace heater. For example, during above-ambient operations at 400° C., heat generated by the furnace heater will be channeled to the cooling device for dissipation, providing a stable load to control the heater against.

When temperature is being decreased, e.g., for analysis at below-ambient temperatures, the cooling device is used to drive the measurement chamber down to the desired temperature. For example, the cooling device may be used to cool the measurement chamber down to −180° C.

Cooling devices used with DSC instrumentation include various types of heat exchangers, such as gas-cooled heat exchangers, liquid-cooled heat exchangers, and change of phase liquid-gas heat exchangers.

Gas-cooled heat exchangers rely on the cooling effect of a gas removing heat from the heat exchanger. Typically, gas-cooled heat exchangers employ vaporized nitrogen as the cooling agent for sub-ambient operation. Gas-cooled heat exchangers, however, suffer several significant drawbacks. First, if liquid nitrogen is vaporized to generate the cold gas, most of the cooling power of the liquid is lost in converting it to a gas. Second, gas is very inefficient at removing heat due to its low heat capacity and high thermal resistance.

Liquid-cooled heat exchangers rely on the cooling effect of a liquid circulating in the heat exchanger. Typically, liquid-cooled heat exchangers employ water, freon or possibly, ethylene glycol, as the cooling agent. Liquid-cooled heat exchangers, however, suffer several significant drawbacks. First, cooling the liquid requires an additional heat exchanger stage to keep the liquid cool as it removes heat from the DSC. Thus, the cooling provided by a liquid cooled heat exchanger is still significantly less efficient than a change of phase liquid-gas system. Second, because the liquid is constantly circulated, contamination of the liquid can result in poor performance and clogging of the circulation tubing. Also, because water is often used, liquid-cooled heat exchangers do not cool very effectively to sub-ambient temperatures.

Change of phase liquid-gas systems are desirable because they rely on the endothermic (energy absorbing) nature of the heat of vaporization. Because the heat exchanger's interaction with the liquified element results in vaporization of the element, a greater amount of heat energy is removed from the heat exchanger. Thus, a nitrogen-based change of phase system provides significantly more cooling than a similar nitrogen-based gas cooling system.

However, current change of phase liquid-gas systems suffer significant drawbacks that limit their practicality. For example, the amount of nitrogen supplied may exceed that which can be vaporized. This results in liquid in the exhaust, which is generally undesirable, and which can lead to frost, leakage, and overflow. On the other hand, if the flow of nitrogen is restricted to substantially eliminate the incidence of liquid in the exhaust, performance in terms of maximum cooling rate and minimum temperature may be unnecessarily compromised. In general, designs for change of phase liquid-gas systems have not permitted realization of the full potential of this approach to cooling. This is a significant drawback.

Additionally, a heater control system will be adversely impacted if the energy removed by the heat exchanger changes rapidly as would occur if the liquid level in the heat exchanger fell to the point where a layer of gas formed between the liquid and the surface of the heat exchanger. This is a significant drawback.

SUMMARY OF THE INVENTION

To overcome these drawbacks or disadvantages in the prior art, and in accordance with the purpose of the invention, as embodied and broadly described, an embodiment of the present invention comprises a nitrogen-based change of phase liquid-gas cooling system including a heat exchanger, a liquid detection/evaporator assembly, a liquid detection feedback loop, and a pressure control device.

A pressure-controlled supply reservoir (e.g., a dewar) feeds a cooling agent such as liquid nitrogen to a heat exchanger mounted to a DSC cell. The DSC cell is cooled as liquid nitrogen contacting the surface of the heat exchanger is vaporized into nitrogen gas. The exhaust (nitrogen gas and, occasionally, small amounts of nitrogen liquid) is fed to a liquid detection/evaporator assembly. If liquid nitrogen in the exhaust is detected by the liquid detection/evaporator assembly, an indication is fed back to a pressure control device using a liquid detection feedback loop. The pressure control device adjusts the amount of pressure on the nitrogen source in order to eliminate liquid in the exhaust. During the cycle where there is liquid in the exhaust, the liquid detection/evaporator assembly also collects and vaporizes the liquid in the exhaust stream so that it can be properly vented to atmosphere in gas form.

The advantages of the present change of phase liquid-gas cooling system are numerous. The liquid detection feature enables a feedback control capability for providing an amount of liquid nitrogen that maximizes cooling while minimizing liquid in the exhaust. The evaporator feature provides for any residual liquid in the exhaust to be vaporized before release, thus reducing frost, leakage, overflow and other problems. Overall, the present invention permits liquid-gas heat exchange to be used to its optimum potential as a most effective cooling system, while minimizing the problems which otherwise might make it impractical.

Accordingly, an object of the invention is to provide a liquid-gas cooling system including a liquid detection means for detecting the presence of a liquid cooling agent, such as liquid nitrogen, in the cooling system exhaust.

Another object of the invention is to provide a liquid detection feedback loop so that, upon the detection of liquid in the exhaust, the amount or level of cooling agent can be adjusted to reduce or eliminate further liquid in the exhaust.

Another object of the invention is to provide a liquid-gas cooling system having evaporator means for vaporizing liquid cooling agent found in the exhaust prior to its release.

These and other objects of the present invention are described in greater detail in the following description of the invention, the appended drawings, and the attached claims.

BRIEF DESCRIPTION OF THE DRAWINGS

FIGS. 19A-1, 19A-2, 19A-3, 19A-4, 19A-5, 19A-6, 19B-1, 19B-2, 19B-3, 19B-4, and 19B-5 provide an exemplary circuit diagram for the control electronics module according to one embodiment of the invention.

DETAILED DESCRIPTION OF THE INVENTION

Figure 1A:
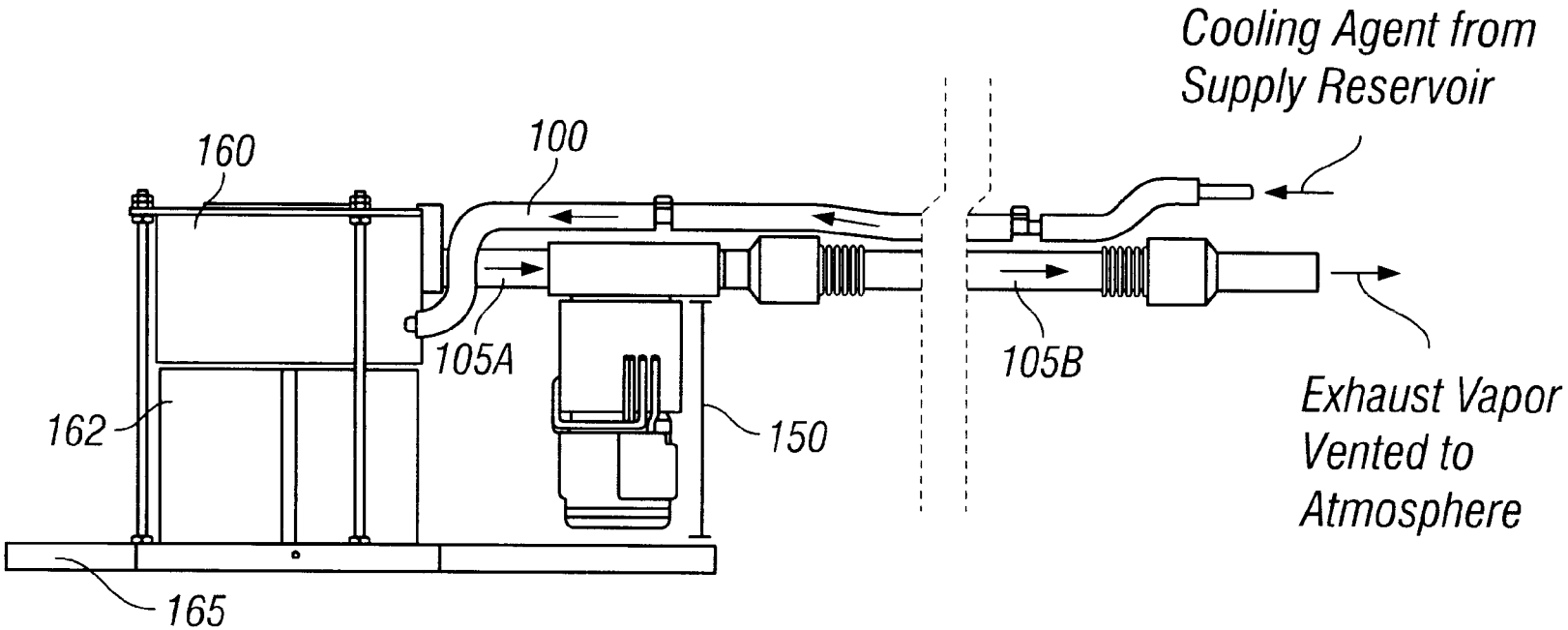
FIG. 1A provides a side view of a preferred embodiment of the liquid nitrogen cooling system heat exchanger and liquid detection assembly that can be coupled to a DSC cell base.

FIG. 1A provides an overview according to an embodiment of the invention of a section of a liquid nitrogen cooling system (supply reservoir not shown). Cooling agent from a supply reservoir is fed through inlet tube 100 into heat exchanger 160, where the liquid cooling agent cools the DSC cell heat exchanger as it is vaporized into nitrogen gas. The cooling byproduct, which includes nitrogen vapor and possibly some liquid nitrogen, exits through exhaust tube 105A and proceeds towards liquid detection/evaporator assembly 150. Liquid detection/evaporator 150 assembly includes a liquid detector capable of determining the presence of liquid nitrogen in the exhaust. If it is determined that liquid is present in the exhaust, an indication is sent via feedback loop to a control electronics module. The control electronics module adjusts a pressure control device so as to reduce the amount of cooling agent supplied and, accordingly, to reduce or eliminate liquid in the exhaust stream. When liquid has been detected, liquid detector/evaporator assembly 150 collects the liquid so that it can be vaporized. Liquid droplets passing over liquid detector/evaporator assembly 150 fall under gravitational pull to the bottom of an evaporator within the liquid detector/evaporator 150. Because the evaporator is maintained at about 40° C., the liquid droplets are vaporized. The resulting nitrogen vapor rises back to the top of liquid detector/evaporator assembly 150 and is carried out exhaust tube 105B to be vented.

Figure 1B:
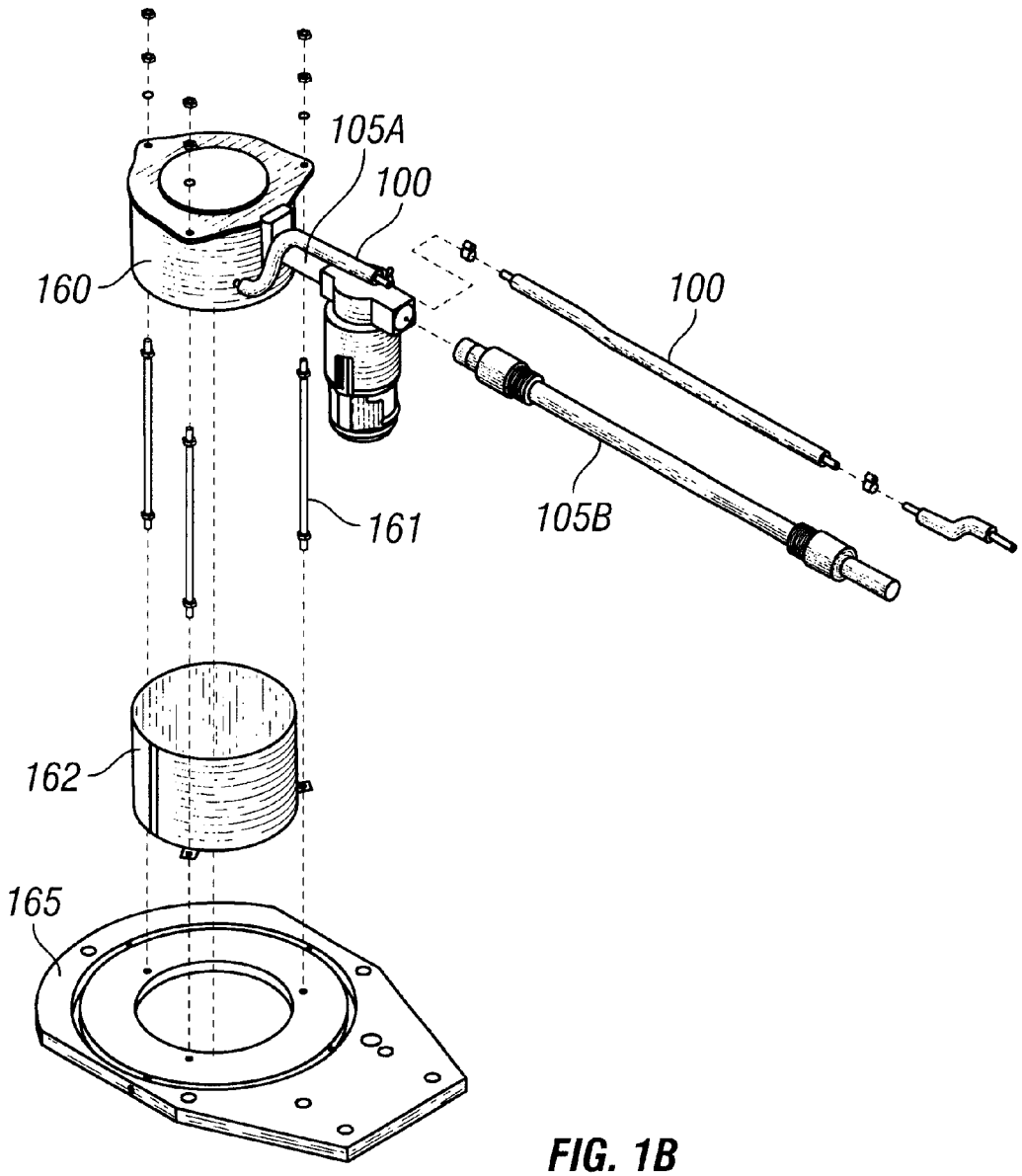
FIG. 1B provides an exploded view corresponding to FIG. 1A of a preferred embodiment of the liquid nitrogen cooling system heat exchanger and liquid detection assembly.

FIG. 1B provides an exploded view of the section of liquid nitrogen cooling system depicted in FIG. 1A. As depicted in FIG. 1B, cooling agent is supplied via inlet tube 100 to heat exchanger 160. Heat exchanger 160 couples to cooler base plate 165 through rods 161 that pass through insulated section 162.

Figure 2:
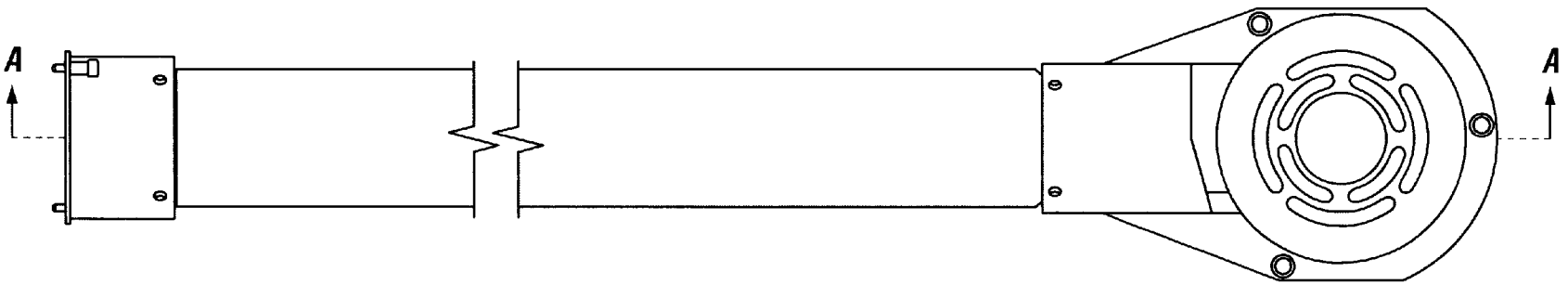
FIG. 2 provides a top view of a preferred embodiment of the liquid nitrogen cooling system.
Figure 3:
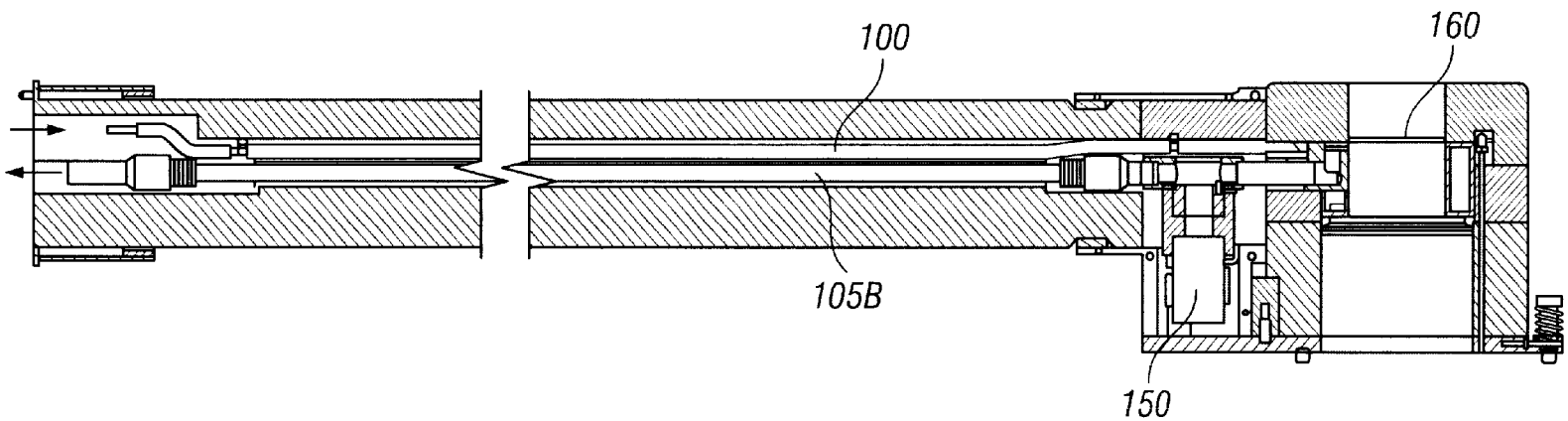
FIG. 3 provides a cutaway side view of a preferred embodiment of the liquid nitrogen cooling system corresponding to the line A—A in FIG. 2.

FIG. 2 provides a top view of the section of the liquid nitrogen cooling system covered with additional insulating hardware. FIG. 3 provides a side view taken through the section A—A of FIG. 2. Although not specifically depicted in FIG. 3, heat exchanger 160 is adapted to be coupled to a DSC cell (not shown) that is to be cooled.

Figure 3A:
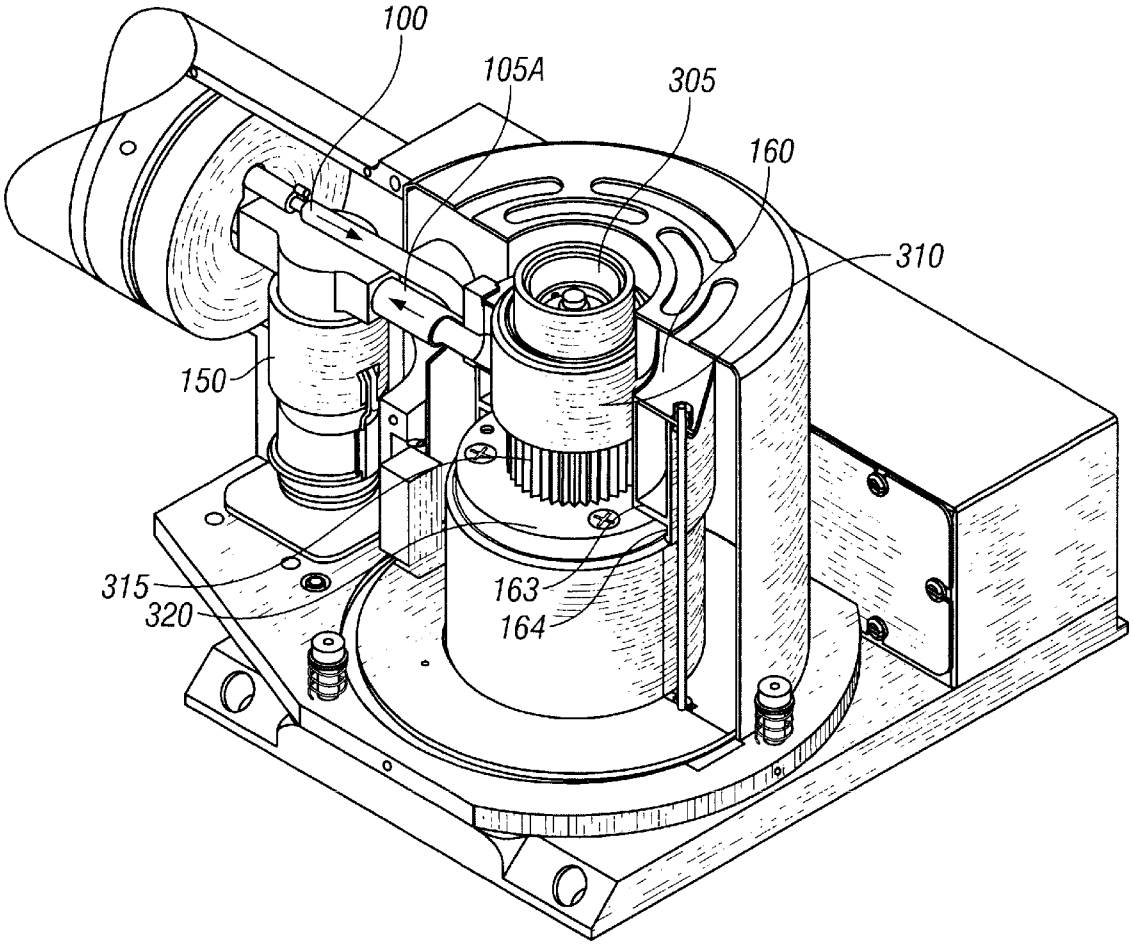
FIG. 3A provides a partial cutaway of the liquid nitrogen cooling system coupled to an exemplary DSC cell.
Figure 3B:
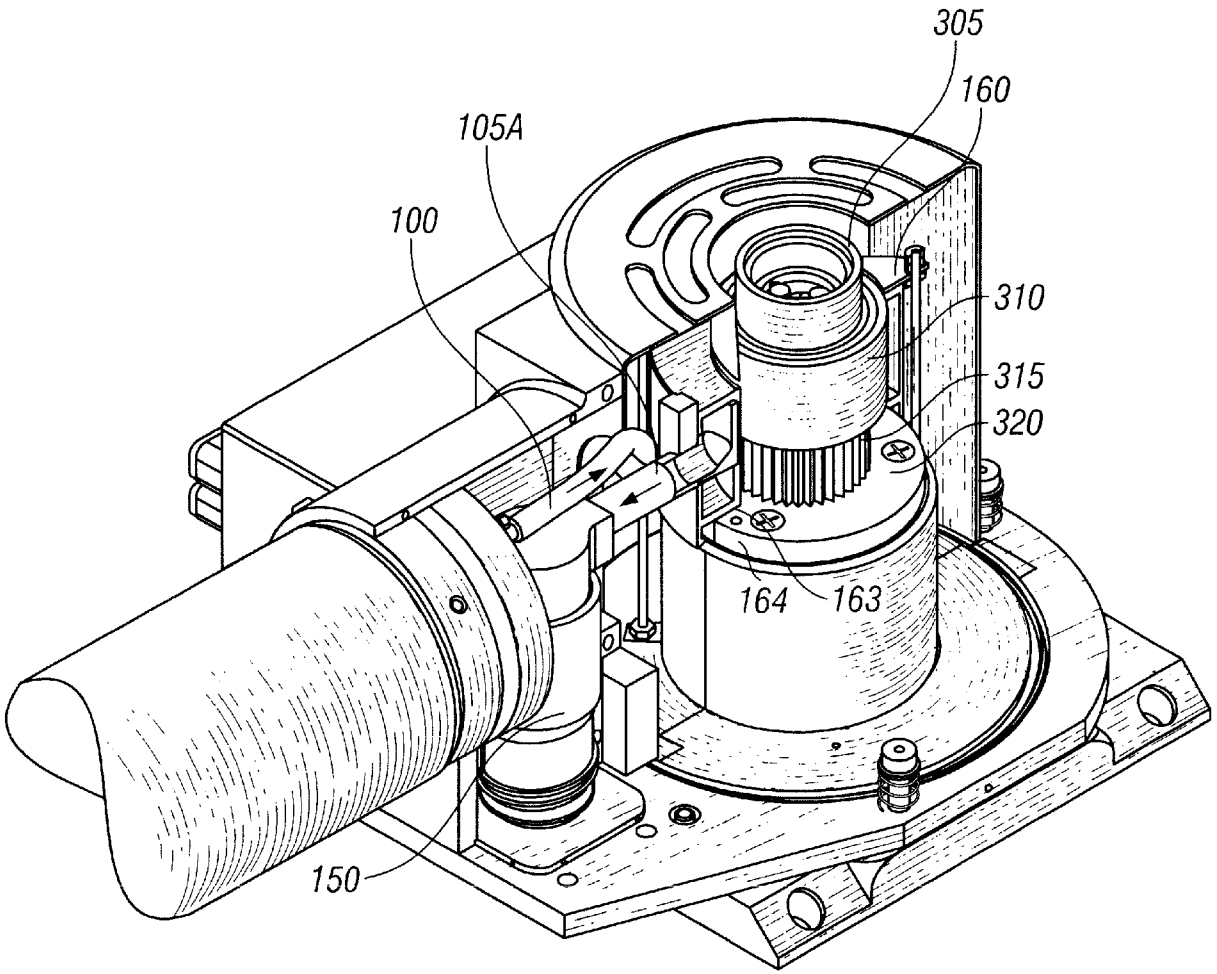
FIG. 3B provides a partial cutaway, rotated about 90 degrees from that of FIG. 3A, of the liquid nitrogen cooling system coupled to an exemplary DSC cell.
Figure 3C:
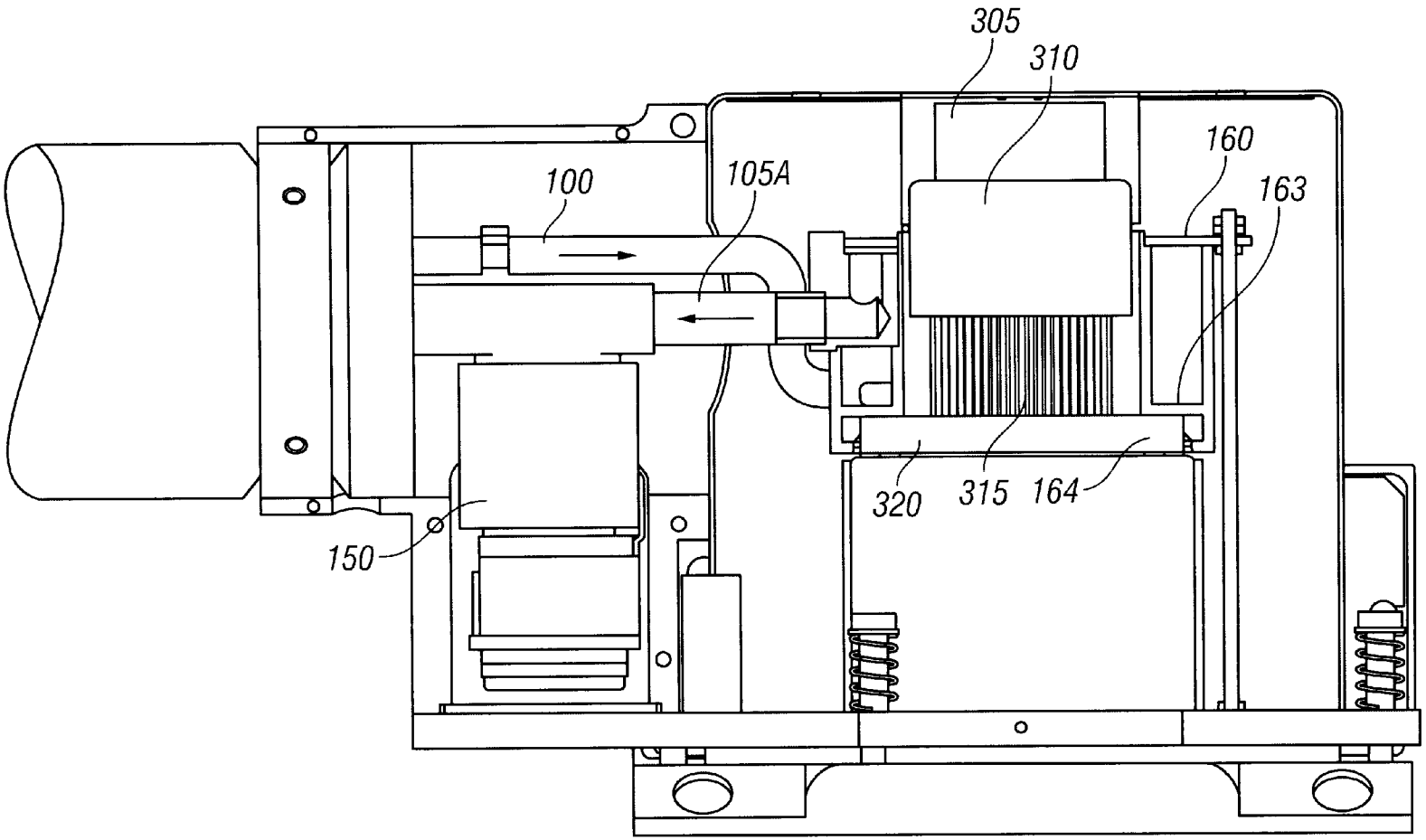
FIG. 3C provides a side view of the liquid nitrogen cooling system coupled to an exemplary DSC cell corresponding to FIG. 3A and FIG. 3B.

In one embodiment, heat exchanger 160 couples to a cooling flange on a DSC cell such as that disclosed in U.S. patent application Ser. No. 09/769,320, entitled "Thermal Analysis Assembly With Distributed Resistance And Intergral Flange For Mounting Various Cooling Devices," which was filed on Jan. 26, 2001, in the name of inventors Robert L. Danley and John W. Schaefer, incorporated herein by reference in its entirety. Accordingly, FIGS. 3A–3C illustrate the coupling of the liquid nitrogen cooling system to an examplary DSC cell. At the outset, it should be appreciated that the DSC cell depicted is examplary only, and that the liquid nitrogen cooling system disclosed herein could easily be intergrated with different DSC cells without departing from the spirit and scope of the invention.

In the partial cutaway of FIG. 3A, the exemplary DSC cell comprises a furnace block assembly comprised of measurement chamber 305 and furnace heater 310. In the exemplary DSC cell, furnace heater 310 is connected to a cooling device coupling assembly comprised of thermal resistance 315 and cooling flange 320. The cooling device coupling assembly provides a physical and thermal interface between the furnace block assembly and the cooling device, here the liquid nitrogen cooling system heat exchanger. Accordingly, the cooling flange 320 couples to heat exchanger 160 at top surface 163 and at side surface 164. A low thermal conductivity ring (e.g., Teflon ring) may be interposed at side surface 164 between heat exchanger 160 and cooling flange 320 so that the predominant heat transfer mechanism is via the top surface 163 of cooling flange 320. In FIG. 3A, the cooling agent is provided by inlet tube 100 and the exhaust is returned by exhaust tube 105A. As discussed in connection with FIG. 1A, liquid detector/evaporator assembly 150 detects and vaporizes liquid in the exhaust.

FIG. 3B provides a partial cutaway rotated approximately 90 degrees from that depicted by FIG. 3A. FIG. 3C provides a cutaway side view corresponding to FIG. 3A and FIG. 3B.

Figure 4:
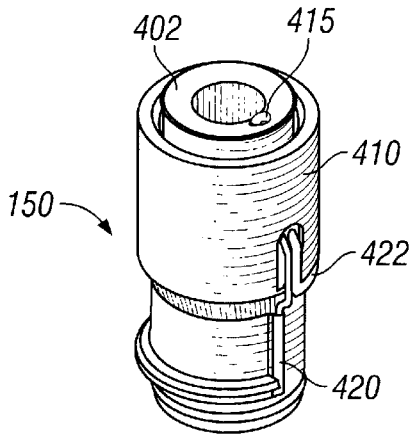
FIG. 4 provides a tilted front view of a preferred embodiment of the liquid detection/evaporator assembly employed by the liquid nitrogen cooling system.
Figure 5:
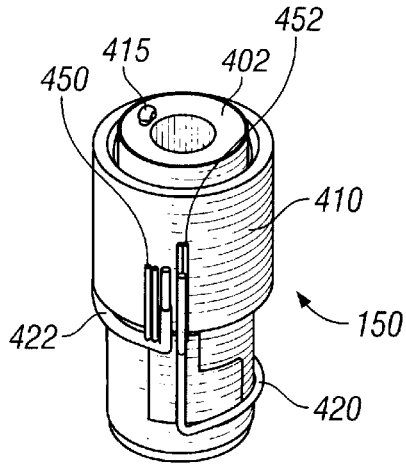
FIG. 5 provides a tilted view of a preferred embodiment of the liquid detector/evaporator assembly which has been rotated approximately 180 degrees from that depicted in FIG. 4.

FIGS. 4 and 5 provide an overview of liquid detector/evaporator assembly 150 (the specific construction of liquid detector/evaporator 150 will be discussed in greater detail with ensuing figures). FIG. 4 provides a tilted front view of an embodiment of liquid detector/evaporator assembly 150. According to this embodiment, liquid detector/evaporator assembly 150 includes thermal detection bead 415, circular member 402, outer sleeve 410, and liquid detector thermocouple leads 420 and 422. In this view, liquid detector thermocouple lead 420 is secured to the heated evaporator with foil tape. FIG. 5 provides a similar view of liquid detector/evaporator assembly 150 without the foil tape, except the assembly has been rotated about 180 degrees. In this view, heater control thermocouple 450 and heating element leads 452 (behind liquid detector thermocouple lead 420) are presented. Heater control thermocouple 450 and heating element 452 are discussed further in connection with FIGS. 6–8.

Figure 6:
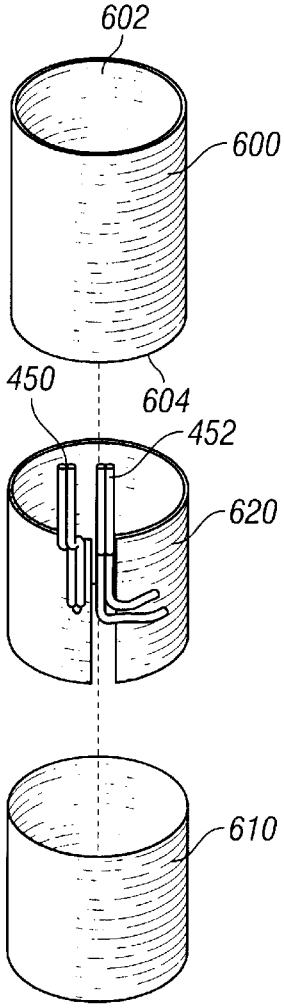
FIG. 6 provides an exploded view of a subassembly of one embodiment of the evaporator assembly.

FIG. 6 illustrates the lower portion 800 (also see FIG. 8 and FIG. 10) of detector/evaporator assembly 150, including collector vessel 600, heater strip 620, heater control thermocouple 450, heating element leads 452, and tape sleeve 610. Collector vessel 600, which has an open upper end 602 and a closed lower end 604, collects liquid droplets from the heat exchange exhaust so that the liquid can be vaporized. Collector vessel 600 is preferably cylindrically shaped, although other shapes could easily be employed without departing from the spirit and scope of the invention. Surrounding collector vessel 600 is heater strip 620, which heats collector vessel 600 to maintain it at a temperature sufficient to vaporize liquid droplets. When nitrogen is employed as the cooling agent, heater strip 620 maintains collector vessel 600 at a nominal temperature operating point of about 40° C., although other temperatures (above the boiling point of nitrogen) could be used. Heater strip 620 is heated through power supplied through heating element leads 452 based on measurements provided by heater control thermocouple 450. Tape sleeve 610, which may be Kapton™ tape, surrounds heater strip 620 and secures heater control thermocouple 450.

Figure 7A:
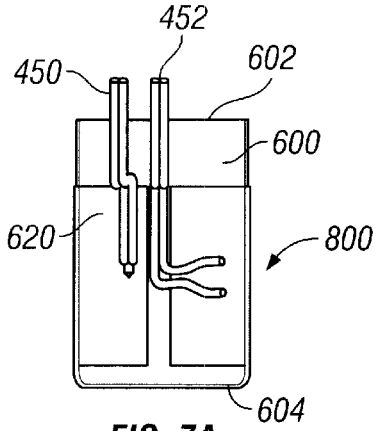
FIG. 7A provides a side view of a subassembly of one embodiment of the liquid evaporator assembly.
Figure 7B:
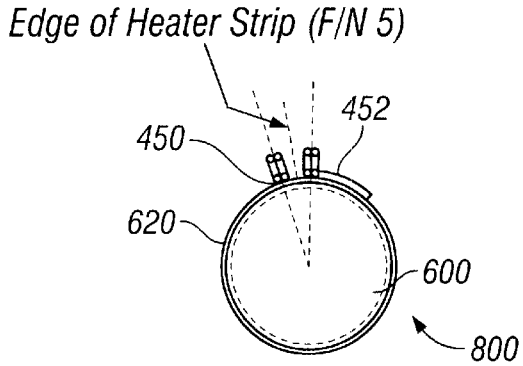
FIG. 7B provides a bottom view of a subassembly of one embodiment of the liquid evaporator assembly.
Figure 8:
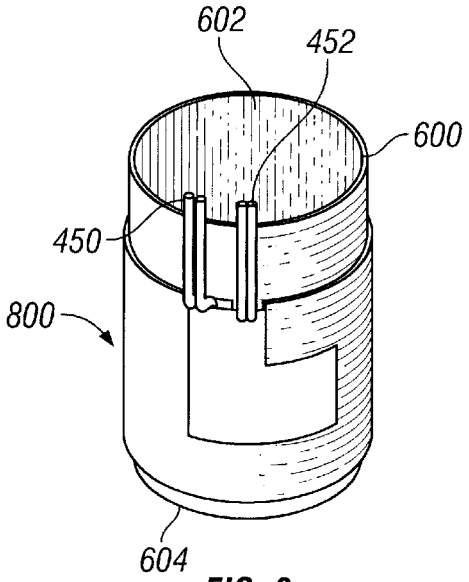
FIG. 8 provides a tilted front view of the integrated subassembly corresponding to FIG. 6.

FIG. 7A provides a side view of the lower portion 800 of detector/evaporator assembly 150 corresponding to FIG. 6. FIG. 7B provides the corresponding bottom view. FIG. 8 provides a tilted front view of the assembled lower portion 800 corresponding to FIG. 6.

Figure 9:
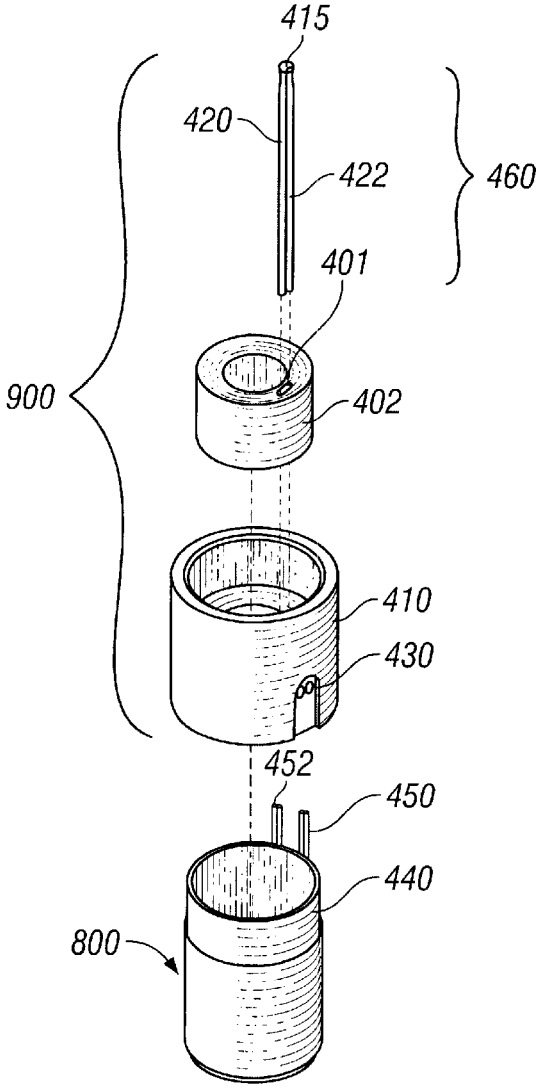
FIG. 9 provides an exploded view of the integration of the subassembly of FIG. 6 with the other components of the liquid detector/evaporator assembly.

FIG. 9 illustrates the integration of the lower portion 800 with the components of upper portion 900 of detector/evaporator assembly 150 (see FIG. 1A). Upper portion 900, which is seated concentrically over lower portion 800, comprises outer sleeve 410, circular member 402, and liquid detector 460. Liquid detector 460 may comprise a thermocouple having thermocouple bead 415 and leads 420 and 422 (e.g., a copper lead and a constantan lead, respectively). In the embodiment depicted, liquid detector 460 feeds through an aperture 401 at the top of circular member 402 and then through aperture 430 on the side of outer sleeve 410. According to this embodiment, the leads of liquid detector 460 are electrically coupled to a feedback loop so that indications of liquid in the exhaust can be communicated to a control electronics module.

In the embodiment depicted by FIG. 9, the liquid detector 460 is a thermocouple comprised of thermocouple leads 420 and 422 and thermocouple bead 415. In this embodiment, lower portion 800 not only evaporates droplets of cooling agent (as previously described), but also provides a source of heat to thermocouple 460 so that liquid can be detected from the sharp drop in temperature when liquid nitrogen contacts thermocouple bead 415. Accordingly, the selection of the nominal temperature operating point for lower portion 800 is a matter of design choice that is influenced by the specific physical configuration of liquid detector/evaporator 150 (see FIG. 1A) and, particularly, the nature of the thermal paths between lower portion 800 and thermocouple bead 415. As previously indicated, according to one embodiment a nominal temperature operating point of 40° C. is selected. If the configuration of detector/evaporator 150 (FIG. 1A) is varied, this nominal temperature operating point may change.

For example, if the components of either lower portion 800 or upper portion 900 are changed, or if the integration of lower portion 800 with upper portion 900 changes, the nature of the thermal paths may change. If the thermal conductivity of the path(s) between lower portion 800 and thermocouple bead 415 increases, the nominal temperature operating point could be lowered. For example, the operating point might be lowered to the range of 0° C.–20° C. On the other hand, if the thermal conductivity of the path between lower portion 800 and thermocouple bead 415 decreases, the operating point might be increased to the range of 60° C.–80° C. The overriding consideration here is that a non-self-heating liquid detector 460 (e.g., a thermocouple) is heated by lower portion 800. The selection of an operating temperature is a function of the particular configuration of liquid detector/evaporator 150 and is a matter of design choice well within the skill of the ordinary artisan. As a general rule, any operating temperature significantly above the temperature of the liquid nitrogen may be acceptable.

According to an alternative embodiment, instead of depending on lower portion 800 as a heat source, an independent heat source could be provided for heating thermocouple 460. In this embodiment, the independent heat source could be applied to upper portion 900 in order to maintain thermocouple 460 at a temperature sufficiently high to enable liquid detection. For example, the independent heat source could comprise heating element leads (similar to element 452 of FIG. 6) or electrically resistive windings (not shown) applied to circular member 402 or to leads 420/422 of FIG. 9.

Continuing with FIG. 9, in other embodiments liquid detector 460 may comprise alternative elements for liquid detection that are either self-heating or that do not require heat. According to one alternative embodiment, liquid detector 460 is a resistance temperature detector (RTD) element. An RTD element uses a material with a resistance that changes as a function of temperature. Thus, the temperature can be determined by measuring the RTD's resistance, directly or indirectly. Because power is applied to the RTD to make this determination, the RTD is considered self-heating in this context. Accordingly, the amount of power supplied to the RTD is selected to maintain the RTD at a temperature sufficiently high to enable liquid detection.

In yet another embodiment, liquid detector 460 may comprise an optical sensor, a capacitive sensor, or a pressure sensor for liquid detection. These sensors do not rely on temperature measurements for liquid detection. Accordingly, they would not need to be heated (as in a thermocouple liquid detector or RTD liquid detector) to perform their liquid detection function.

An optical detector could rely on the refractive index shift between gas and liquid states in order to detect liquid in the exhaust. A capacitive detector could be constructed that would react to the dialectric properties of nitrogen in liquid versus gas form. The plates of the capacitor may have the exhaust passing between them with capacitance increasing when liquid is present. A pressure detector would make a differential pressure measurement of the exhaust stream passing through an orifice or other minimally restrictive structure, thereby measuring the pressure increases that arise when liquid passes through.

Figure 10:
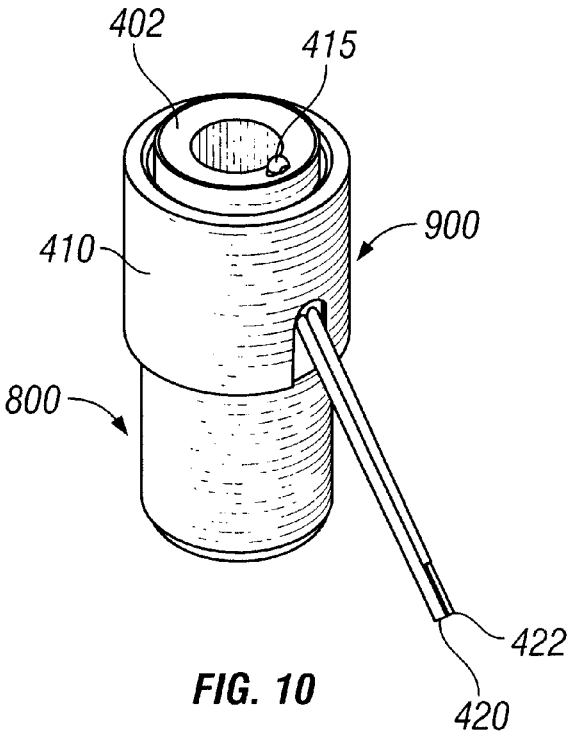
FIG. 10 provides a tilted front view of the assembled liquid detector/evaporator assembly corresponding to FIG. 9.

Turning to FIG. 10, this figure illustrates an assembled liquid detector/evaporator assembly 150 corresponding to the exploded view of FIG. 9.

Figure 11:
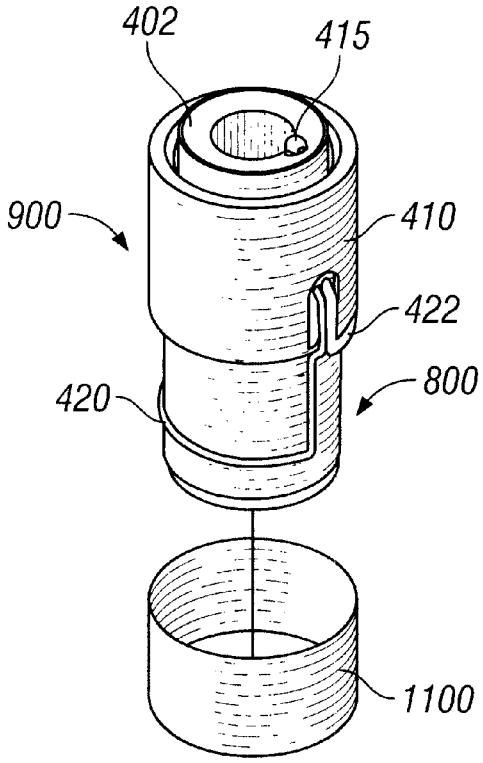
FIG. 11 illustrates the attachment of foil tape to the assembled liquid detector/evaporator assembly depicted in FIG. 10.

In FIG. 11, it can be seen that positive lead 420 of liquid detector 460 is routed down from outer sleeve 410 and is then wrapped around roughly 270 degrees of the circumference of lower portion 800. Negative lead 422 of liquid detector 460 is routed down from outer sleeve 410 and is then wrapped around roughly 90 degrees of the circumference of lower portion 800. Foil tape 1100 is attached to lower portion 800 in order to secure the leads of liquid detector 460. The purpose of attaching the leads of liquid detector 460 to lower portion 800 is to provide heat flow from heated lower portion 800 up to the liquid detector bead 415. This heats thermocouple bead 415 in the presence of cold gas. When thermocouple bead 415 contacts liquid, however, the vaporization energy (instead of falling into collector 600 [FIG. 6], some of the liquid in the exhaust is vaporized by thermocouple bead 415) overcomes this heat flow so as to provide liquid detection through the rapid cooling of the bead.

Figure 12A:
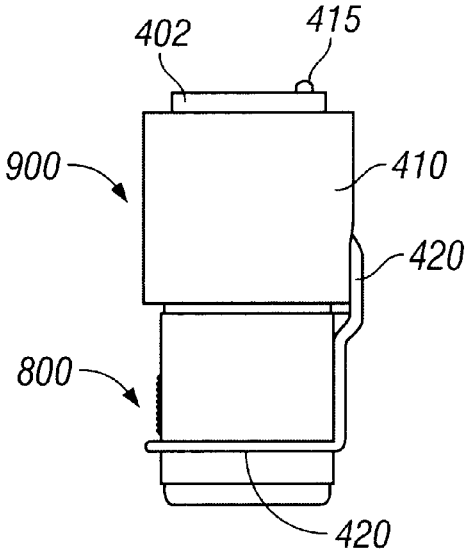
FIGS. 12A and 12B provide two side views of the liquid detector/evaporator assembly.
Figure 12B:
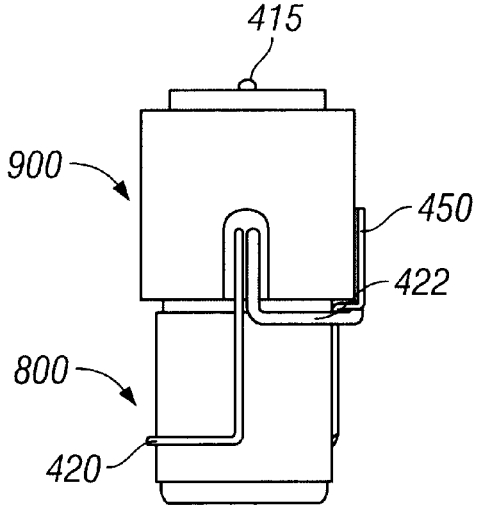

FIGS. 12A and 12B provide two side views of an assembled liquid detector/evaporator assembly 150 (without the foil tape). FIG. 12B is rotated approximately 90 degrees from FIG. 12A in order to illustrate the disposition of leads 420 and 422 around lower portion 800.

Figure 13:
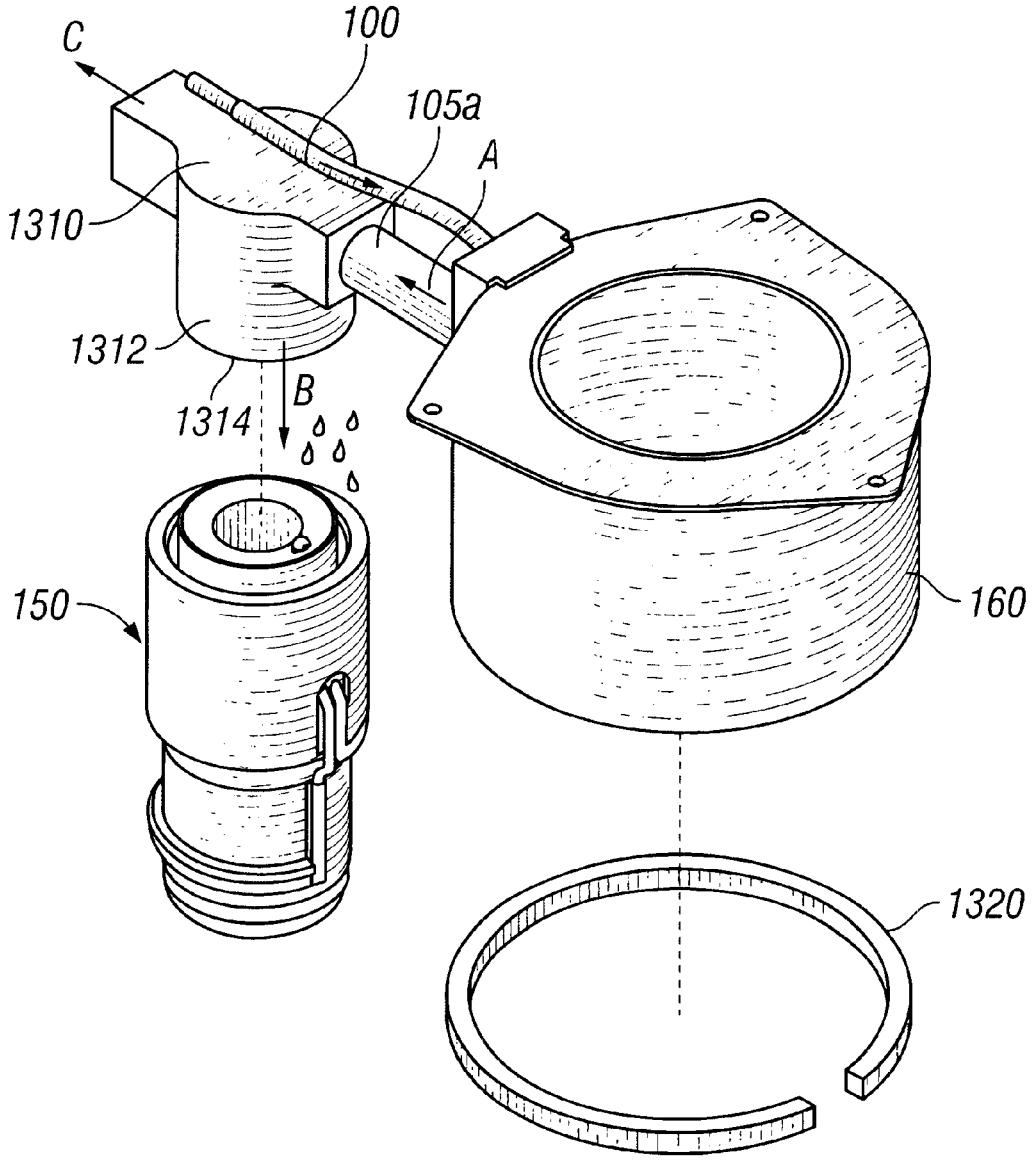
FIG. 13 provides an illustration, according to one embodiment of the invention, of the integration of the liquid detector/evaporator assembly with a heat exchanger unit.

FIG. 13 illustrates the integration of liquid detector/evaporator 150 with heat exchanger 160. Ring 1320 is a snap ring, which could be teflon, that is fitted into an internal groove (not shown) at the cooling interface surface of heat exchanger 160. Snap ring 1320 is used to center heat exchanger 160 on a DSC cell, such as to a cooling flange of a DSC cell (as discussed above in connection with FIG. 3 and FIGS. 3A–C). Emanating from heat exchanger 160 is inlet tube 100 and exhaust tube 105A. Exhaust tubes 105A and 105B connect to a T-section assembly 1310 which has an aperture on each lateral end for exhaust tubes 105A and 105B. T-section assembly 1310 has a generally cylindrically shaped middle section 1312 which has an open bottom end 1314 for mating with liquid detector/evaporator 150. In this manner, gas and liquid exhaust exit the heat exchanger 160 as depicted by the arrow marked "A." Liquid droplets fall through the bottom open end 1314 of T-section assembly 1310, as depicted by the arrow marked "B." Vapor exhaust exits the entire assembly to be vented to atmosphere, as depicted by the arrow marked "C."

Figure 14:
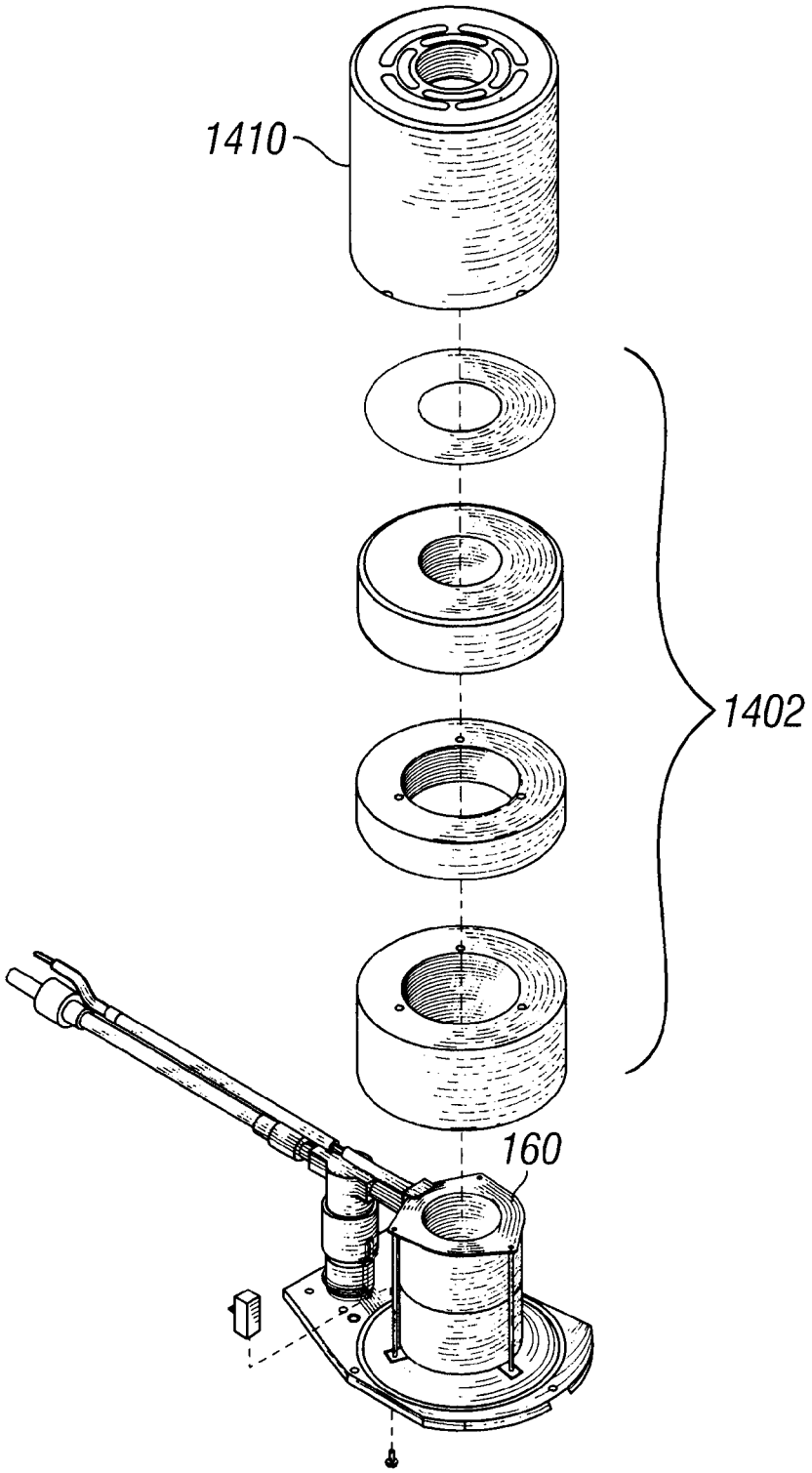
FIG. 14 provides an exploded view according to one embodiment of the invention of the liquid nitrogen cooling system heat exchanger and liquid detection assembly with insulation.

FIG. 14 illustrates that heat exchanger 160 may be covered by several layers of insulation 1402 and capped with housing 1410.

Figure 15:
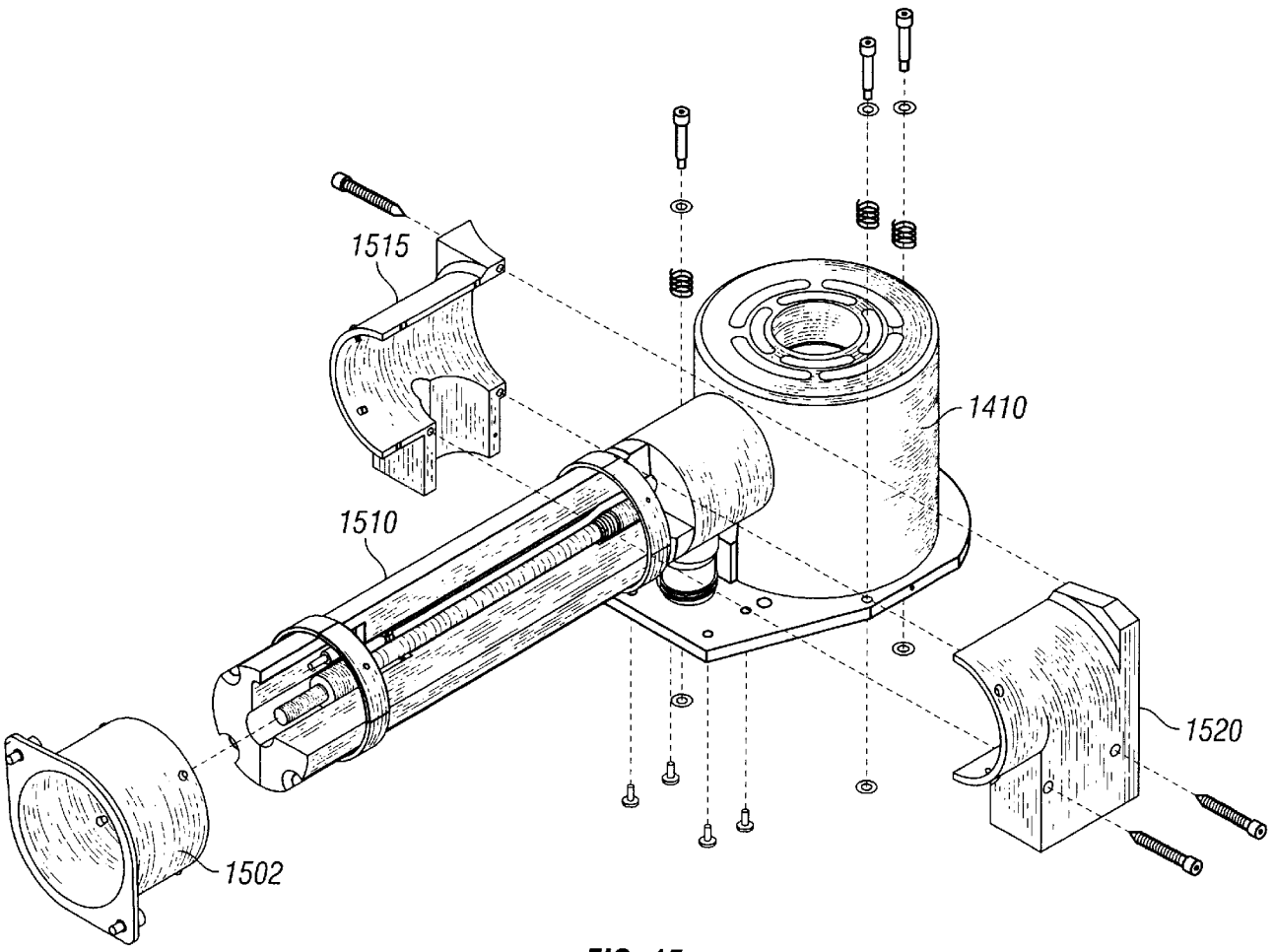
FIG. 15 provides an aspect view of one embodiment of the liquid nitrogen cooling system including insulation and hardware.

FIG. 15 illustrates the attachment of left strain relief 1515 and right strain relief 1520, as well as the routing of inlet tube 100 and exhaust tube 105B along insulation tube ember 1510. Insulation tube member 1510 ends at termination cap 1502.

Figure 16:
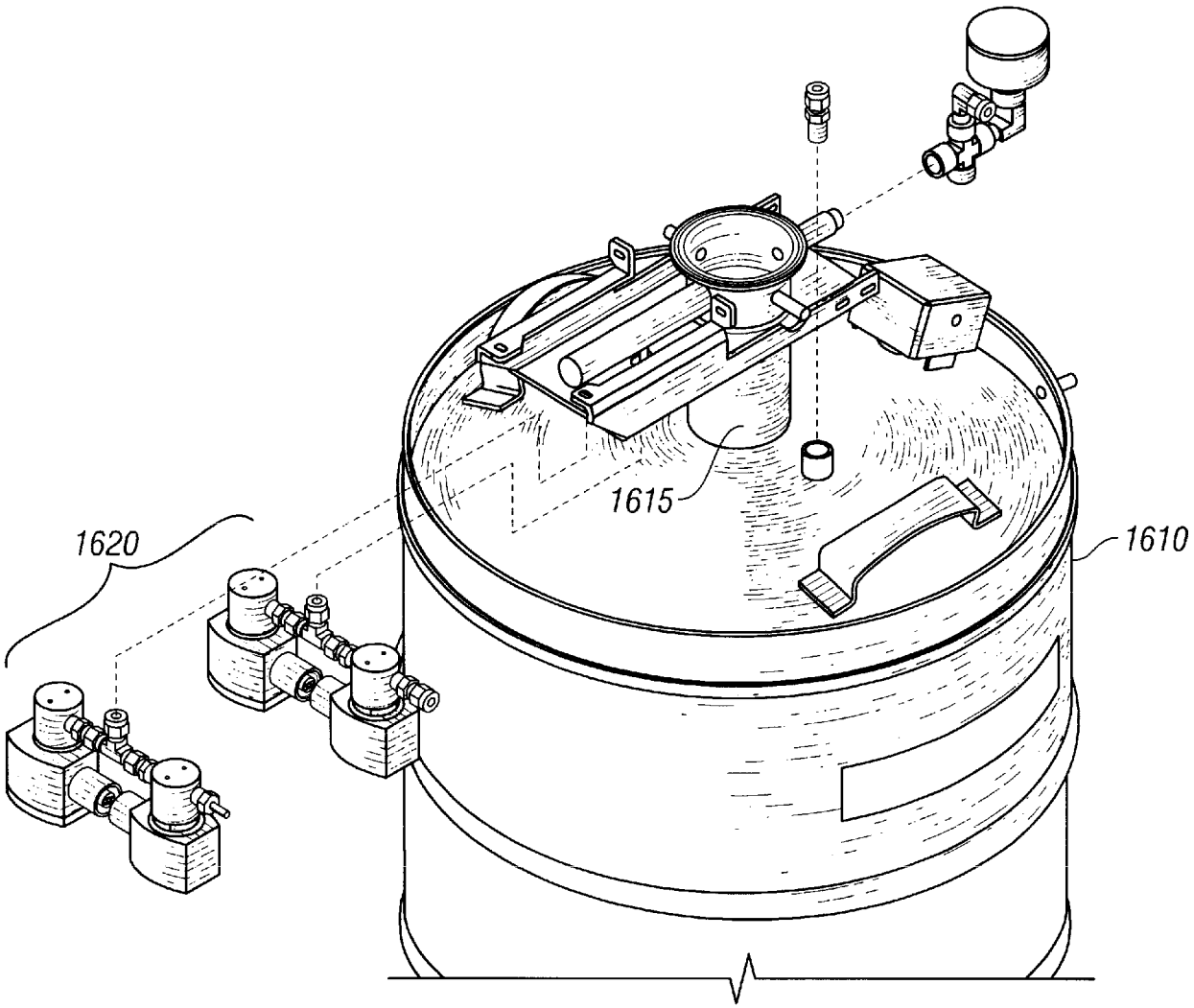
FIG. 16 provides an aspect view of a supply reservoir according to one embodiment of the invention.

FIG. 16 illustrates supply reservoir 1610, which is controlled by a pressure control device to regulate the amount of cooling agent supplied to the beat exchanger. The pressure control device is utilized to control the pressure in supply reservoir 1610. This pressure is generally controlled with a feedback loop from the liquid detector/evaporator 150. As depicted in FIG. 16, coupled to manifold 1615 are four pressure control valves 1620 that comprise the aforementioned pressure control device. According to an embodiment, pressure control valves 1620 are employed to increase pressure and decrease pressure based on liquid detection. Coolant flow requirements may vary with temperature at the heat exchanger, e.g., from less than 2 psi at −180° C. to 8 psi or higher at 500° C. Pressure control valves 1620 may be employed to increase/decrease pressure according to a step (e.g., to increase pressure by a step of 2 psi from 8 psi to 10 psi) or to increase/decrease pressure according to a pressure rate (e.g., an increase at a rate of +1 psi/minute). The operation of pressure control valves 1620 will be discussed further below.

Figure 17:
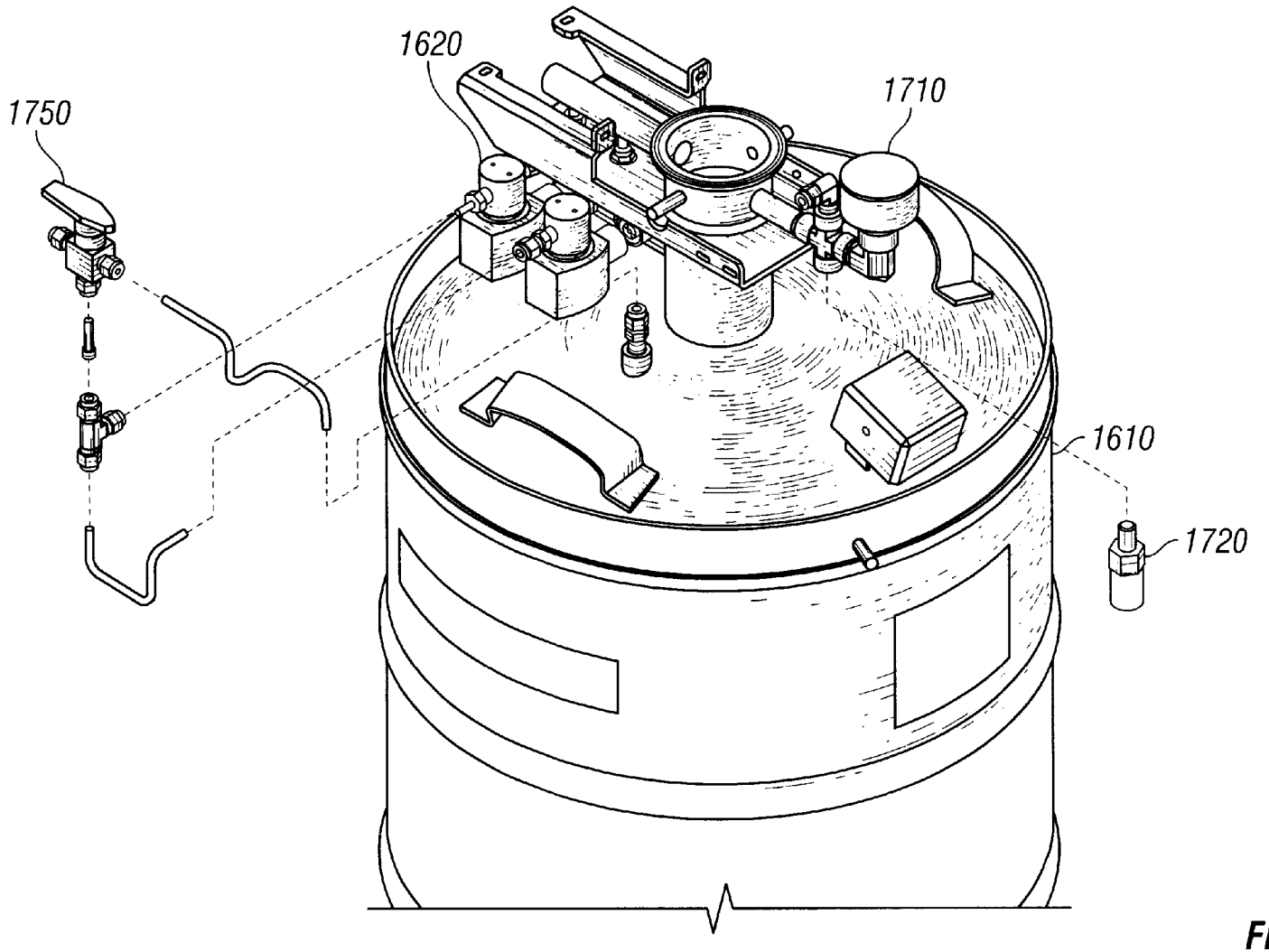
FIG. 17 provides an aspect view rotated from that depicted in FIG. 16 of a supply reservoir according to one embodiment of the invention.
Figure 18:
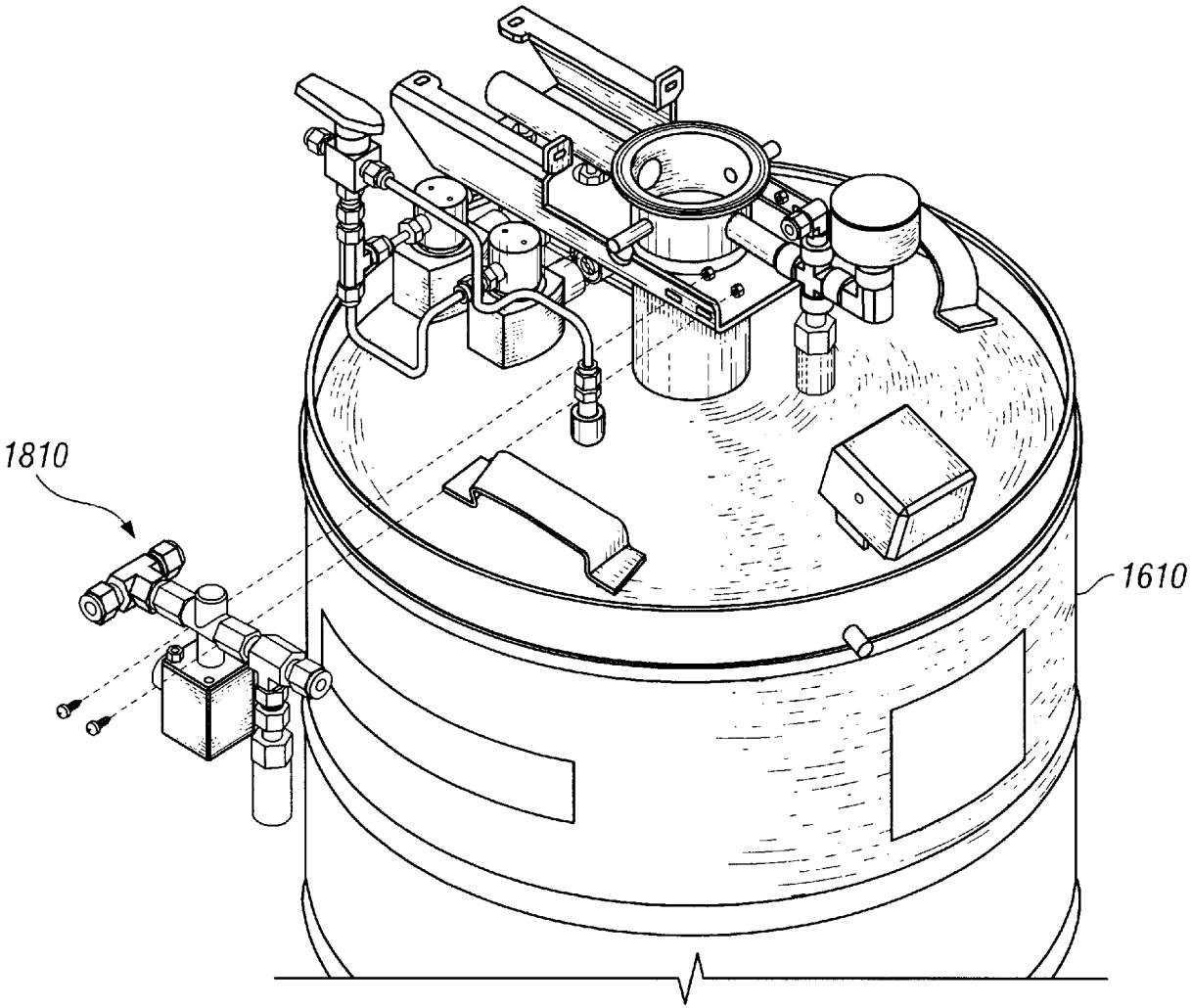
FIG. 18 provides an aspect view similar to that of FIG. 17 of a supply reservoir according to one embodiment of the invention.

FIG. 17 provides a view of supply reservoir 1610 rotated about 90 degrees from that depicted in FIG. 16. Element 1710 is a safety pressure gauge, which is coupled to pressure relief valve 1720. Pressure control valves 1620 are coupled to three-way valve 1750 which permits selection between internal pressurization and external pressurization. External pressurization is beneficial because it preserves the liquid nitrogen in the tank by obviating the need to boil (vaporize) liquid nitrogen in the tank in order to increase pressure. FIG. 18, which is oriented similar to FIG. 17, illustrates a valve 1810 that is employed for filling supply reservoir 1610 from a bulk source.

Figure 19:
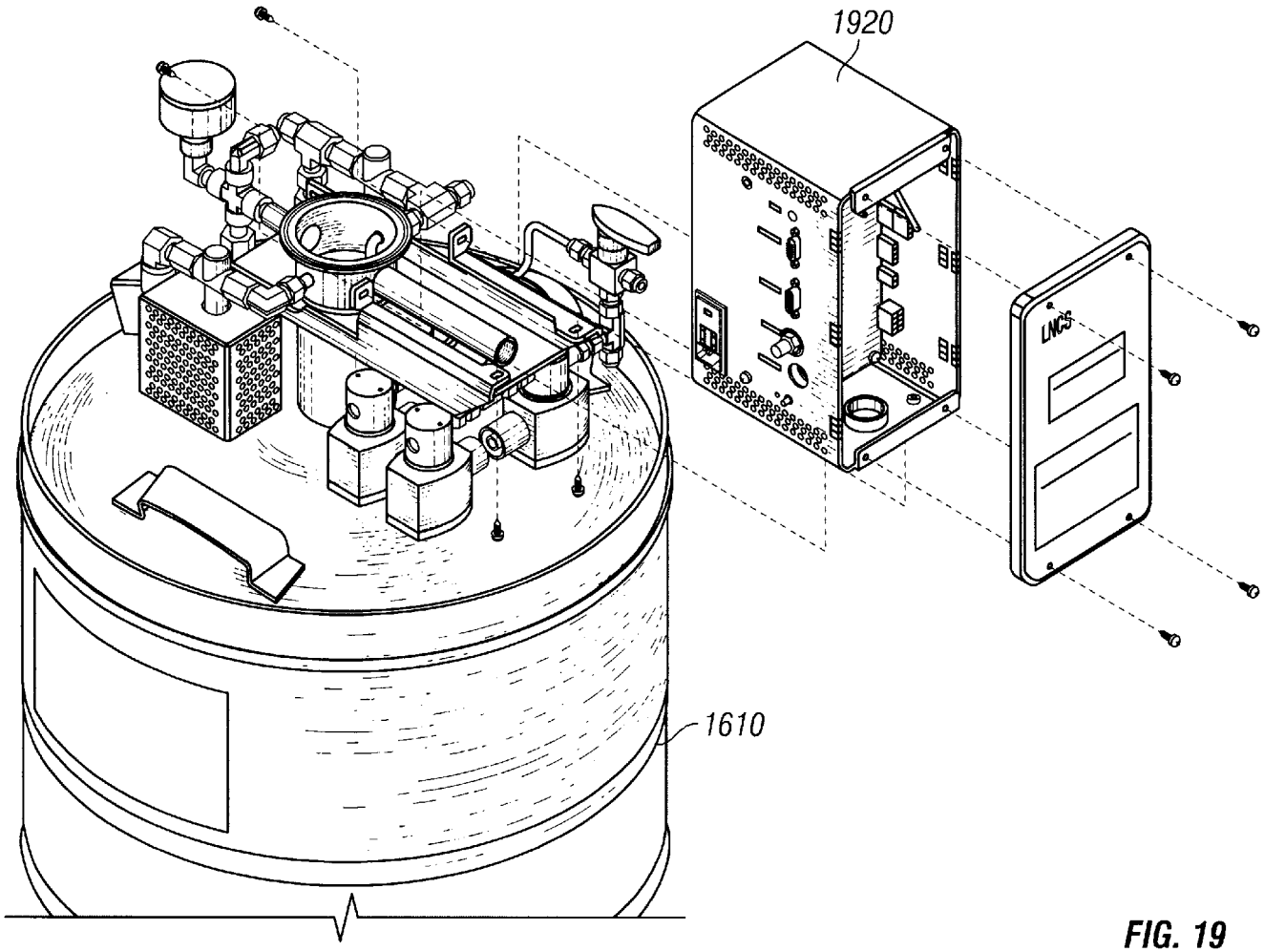
FIG. 19 provides an aspect view of a supply reservoir according to one embodiment of the invention integrated with a control electronics module.
Figures 1, 19A:
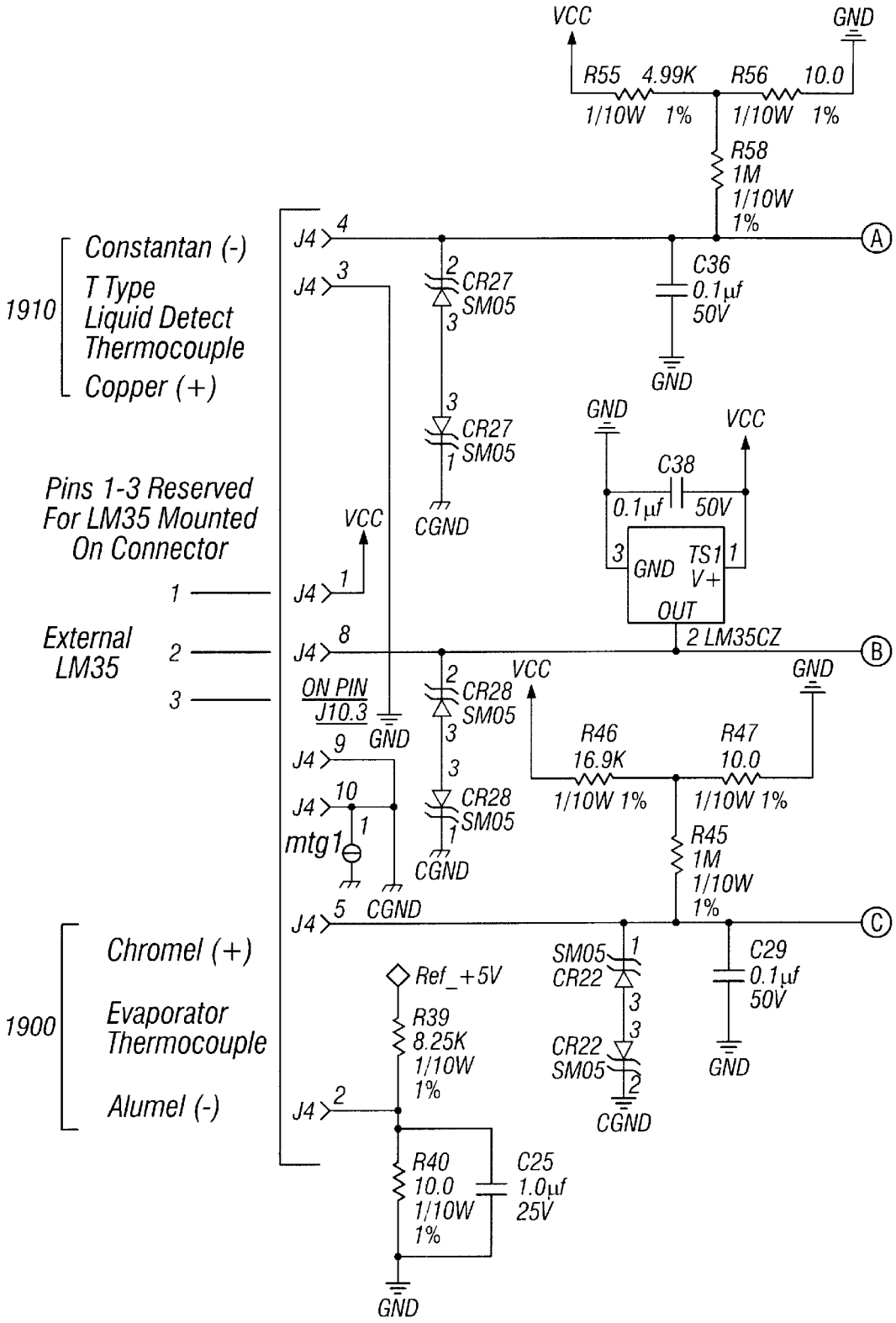
Figures 2, 19A:
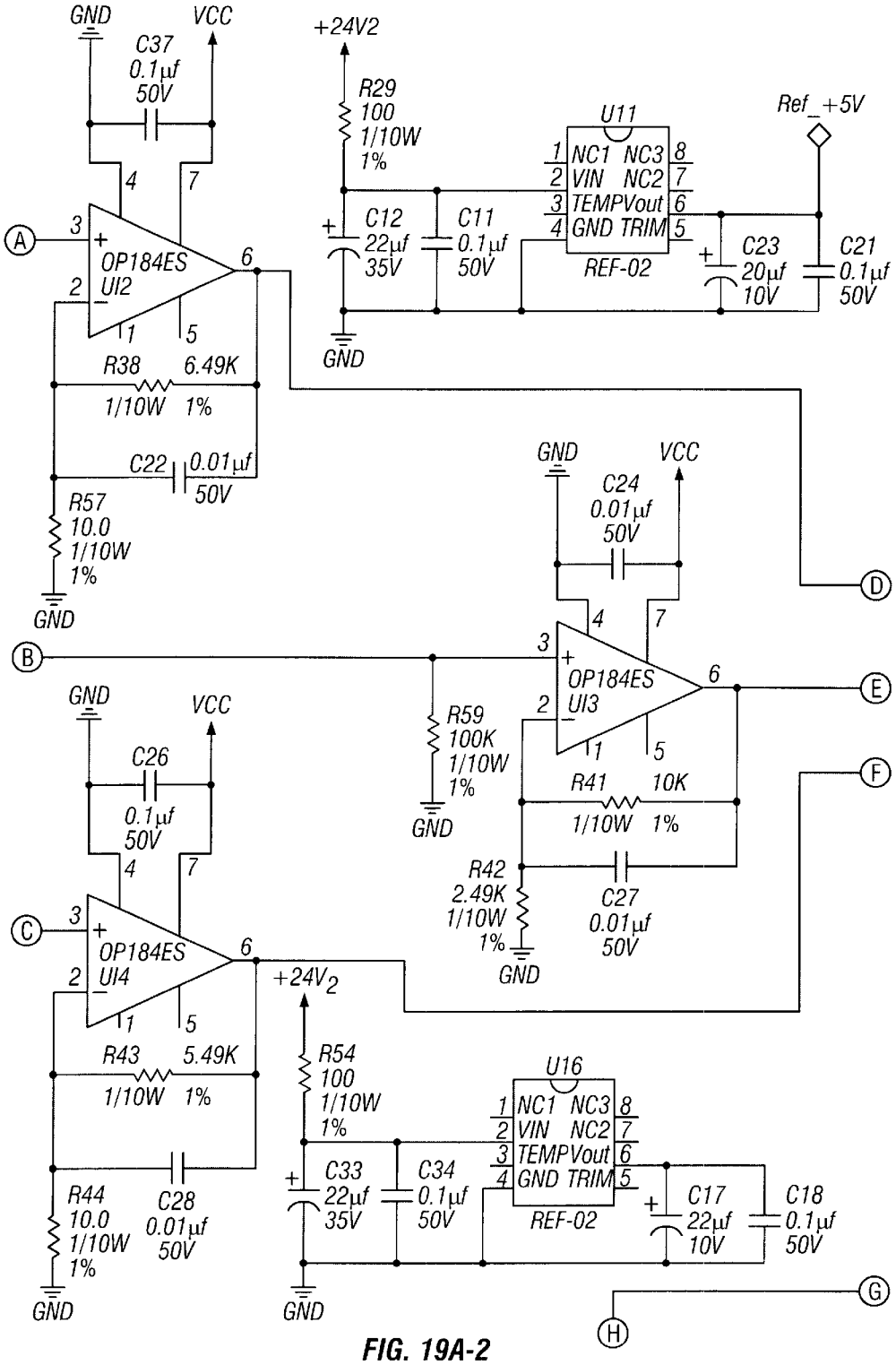
Figures 3, 19A:
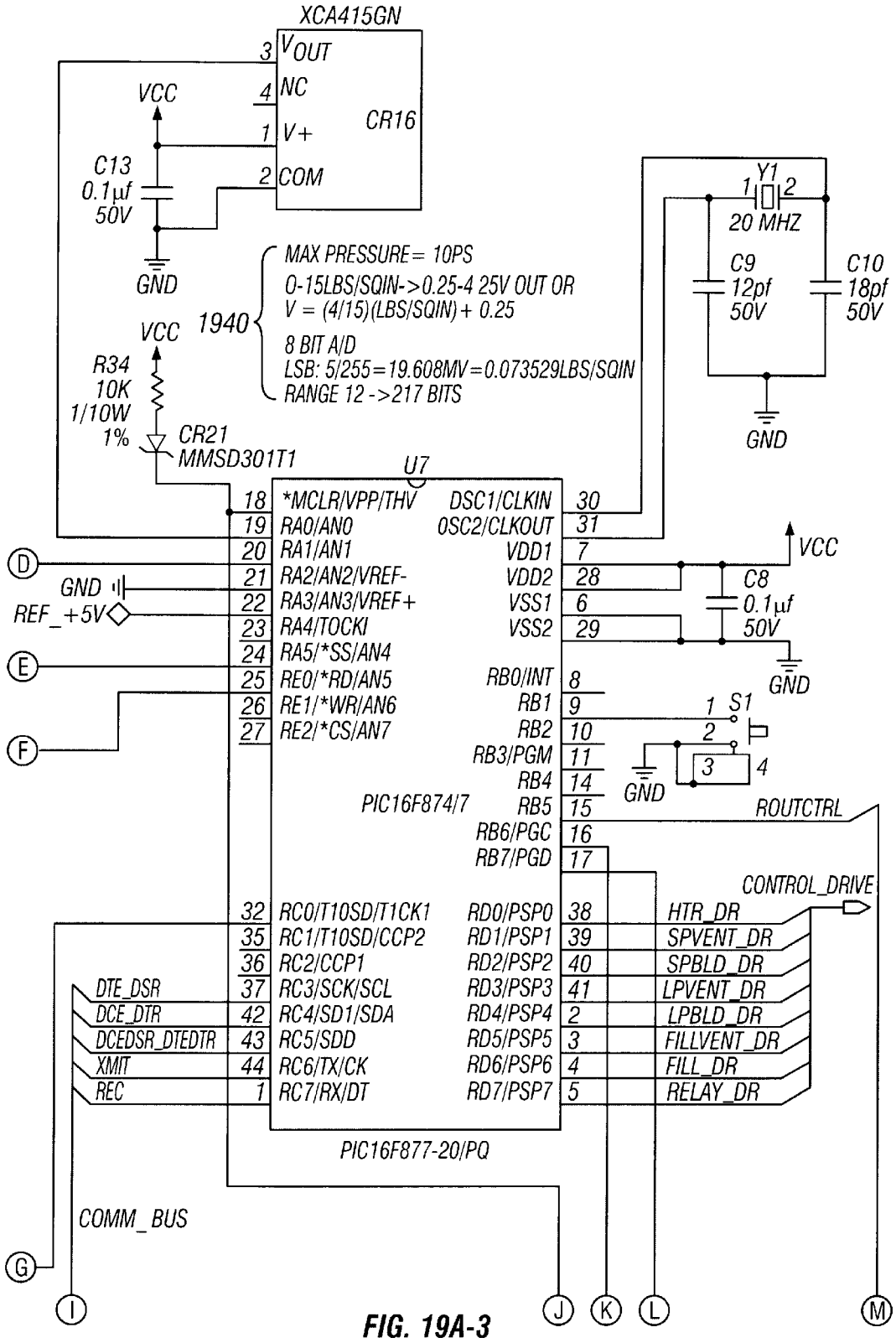
Figures 4, 19A:
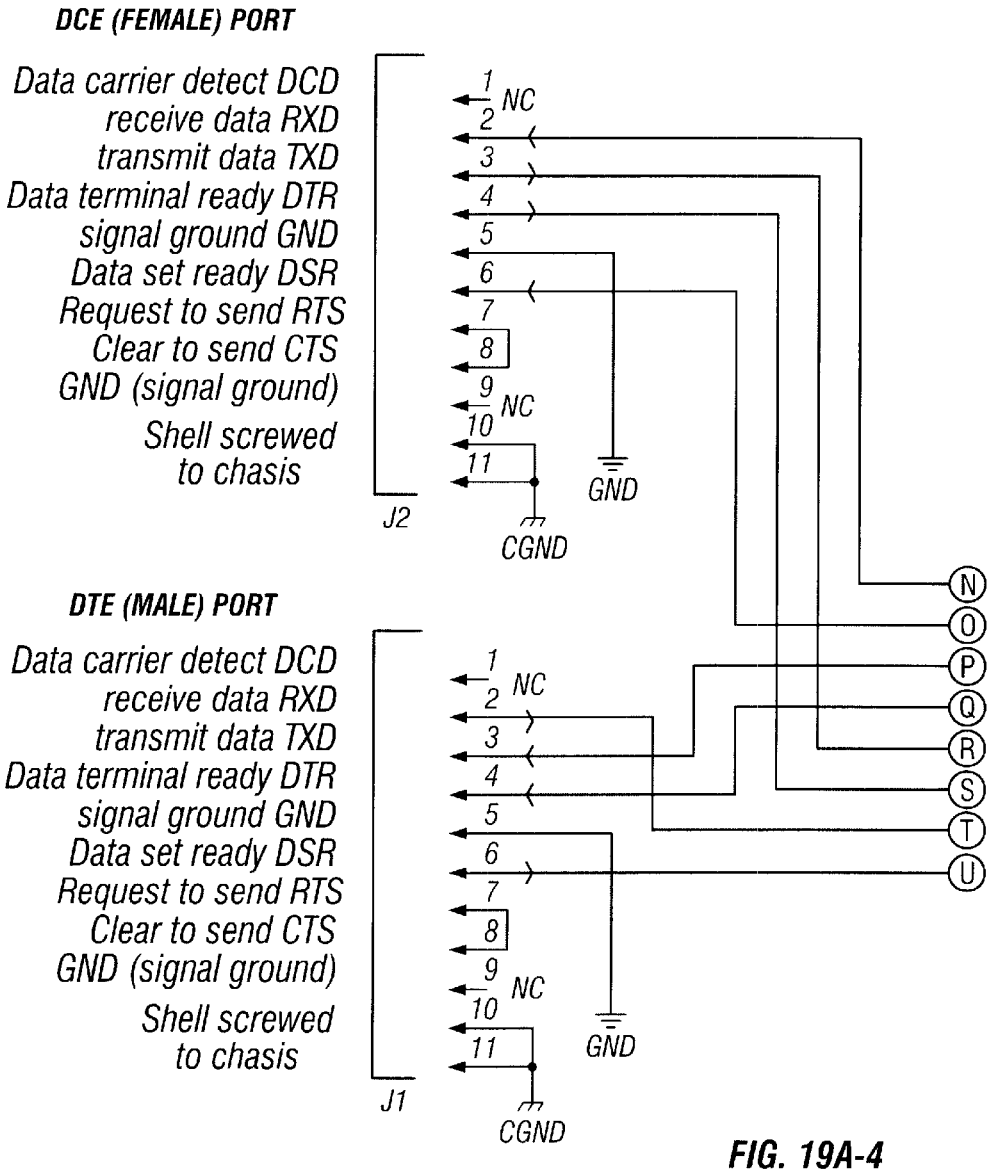
Figures 5, 19A:
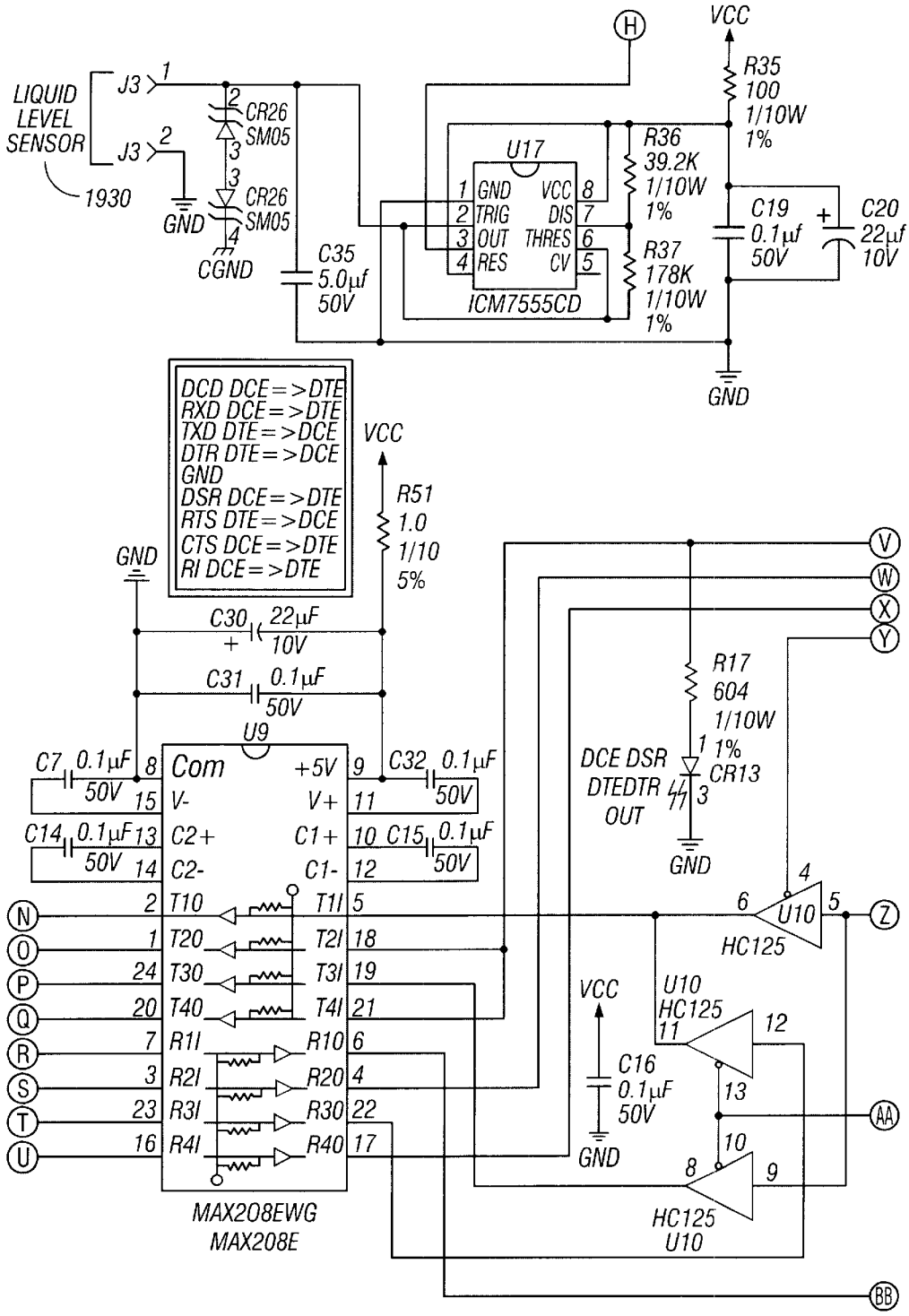
Figures 6, 19A:
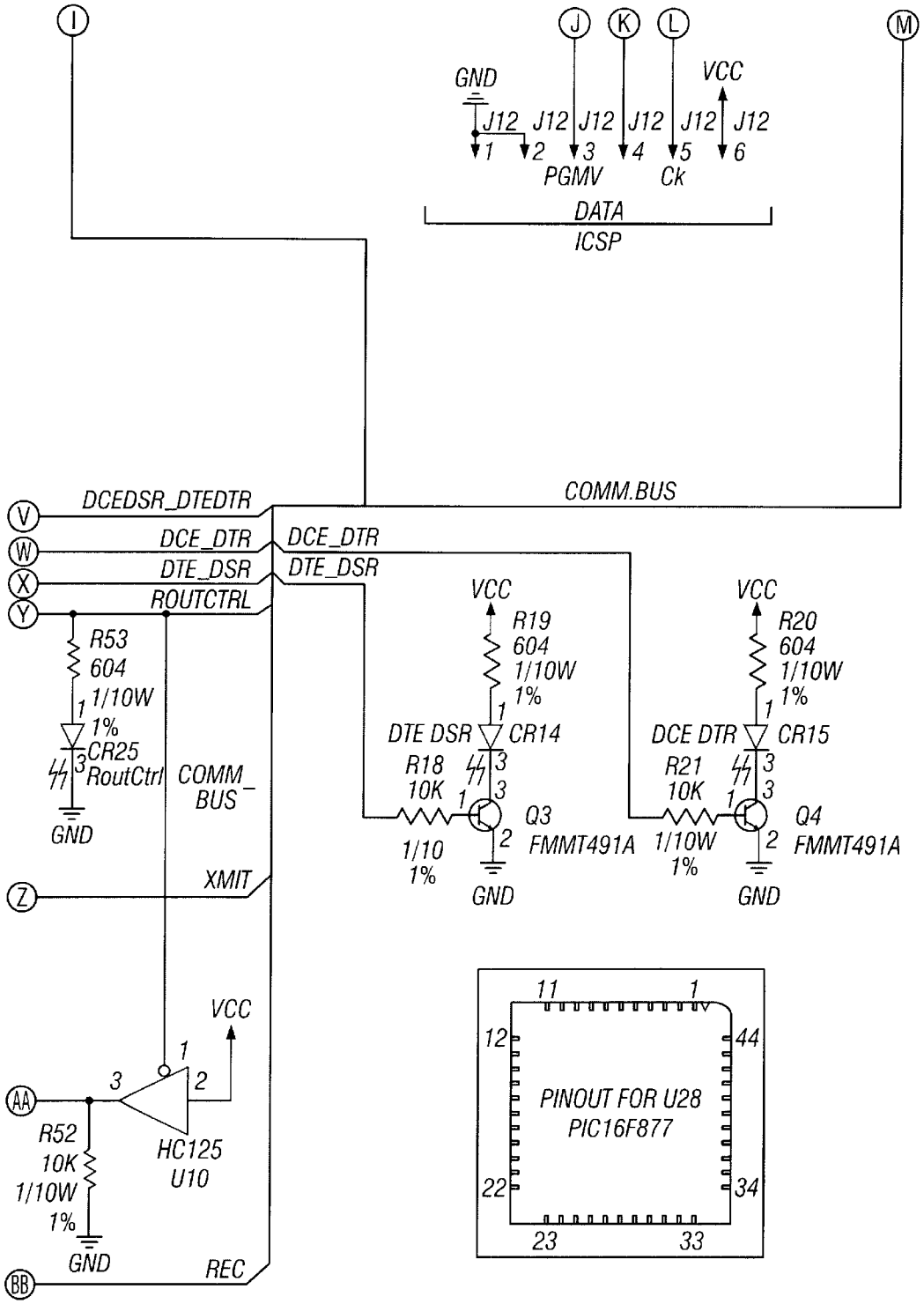
Figures 1, 19B:
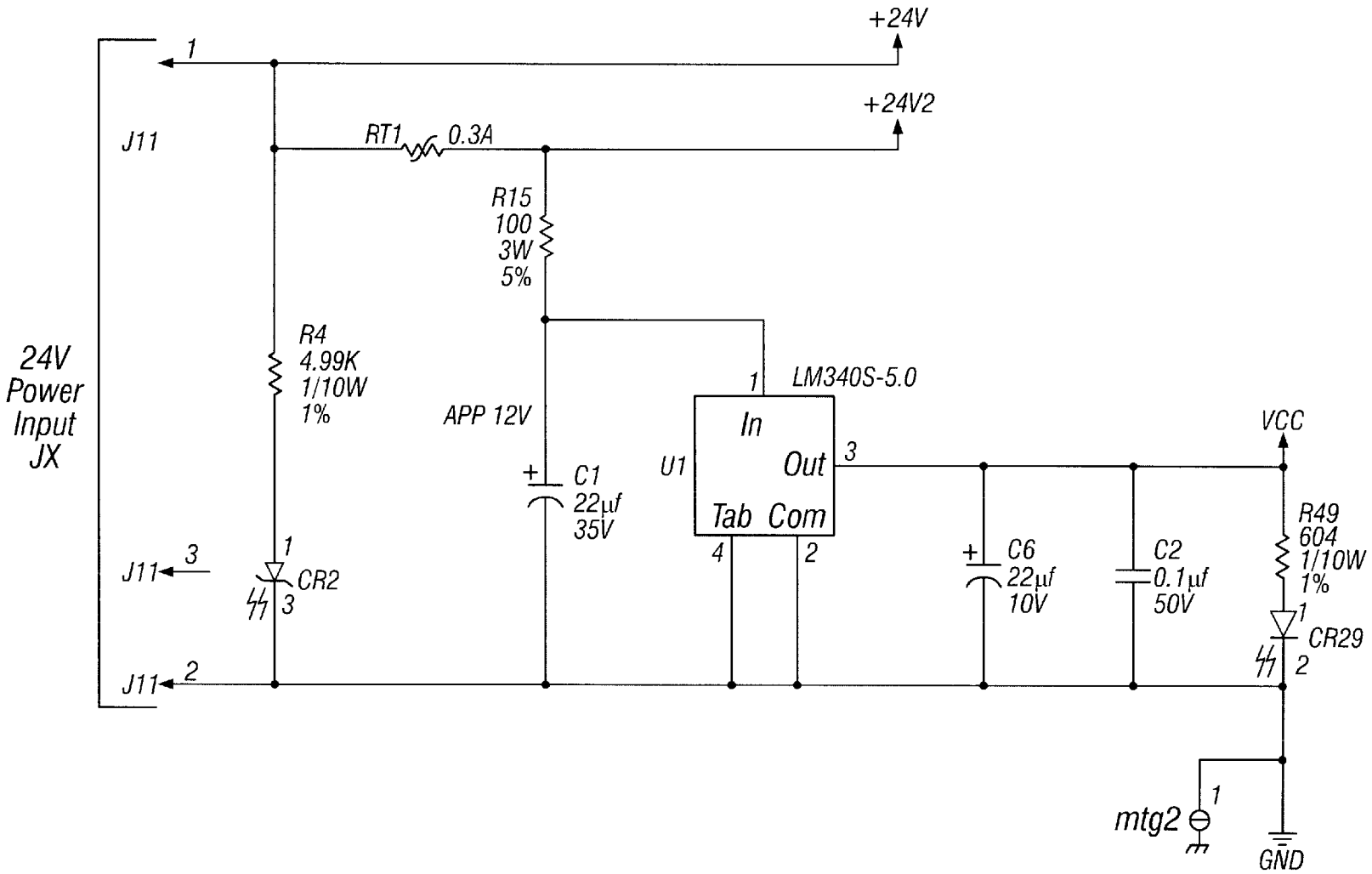
Figures 2, 19B:
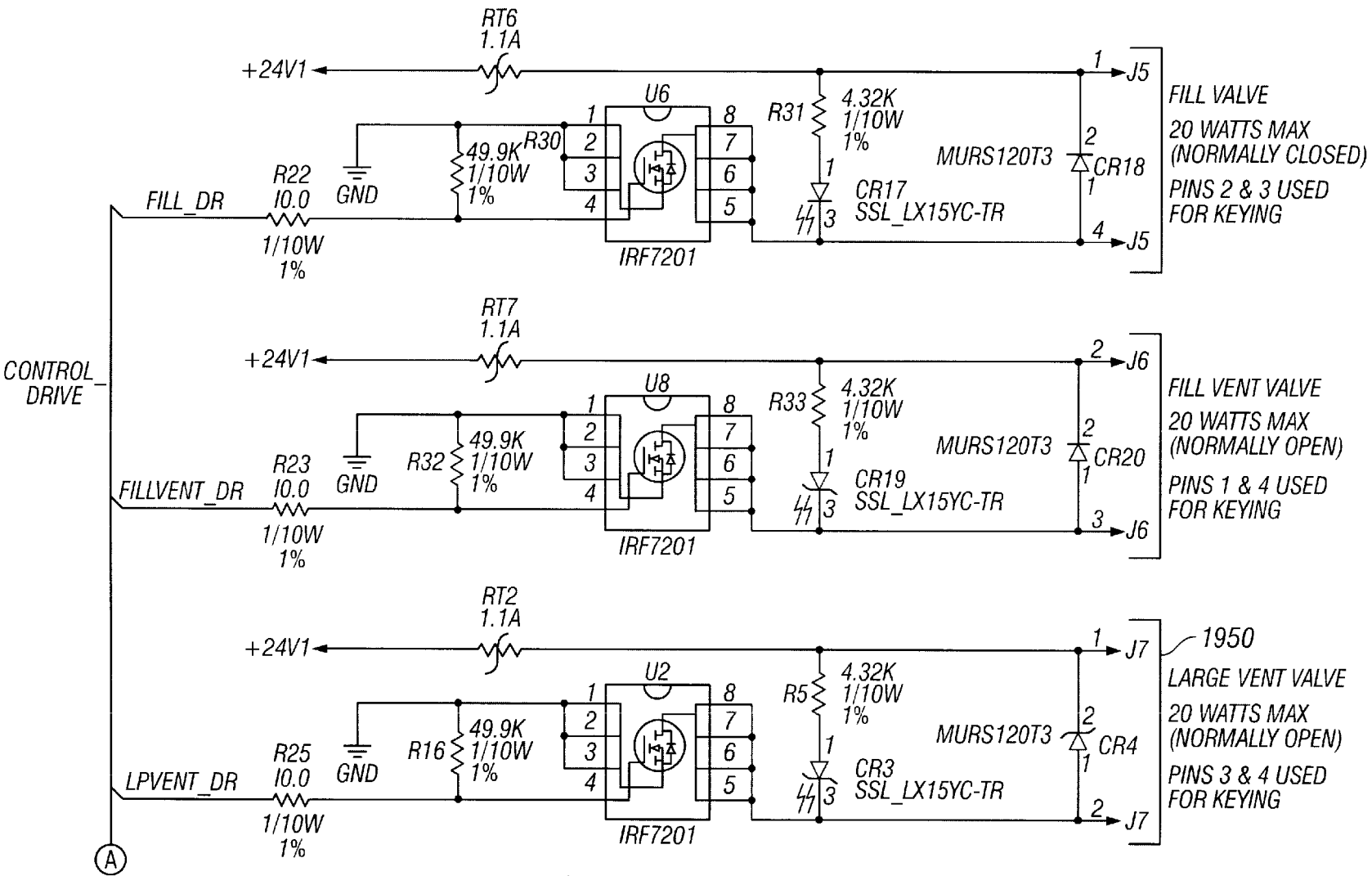
Figures 3, 19B:
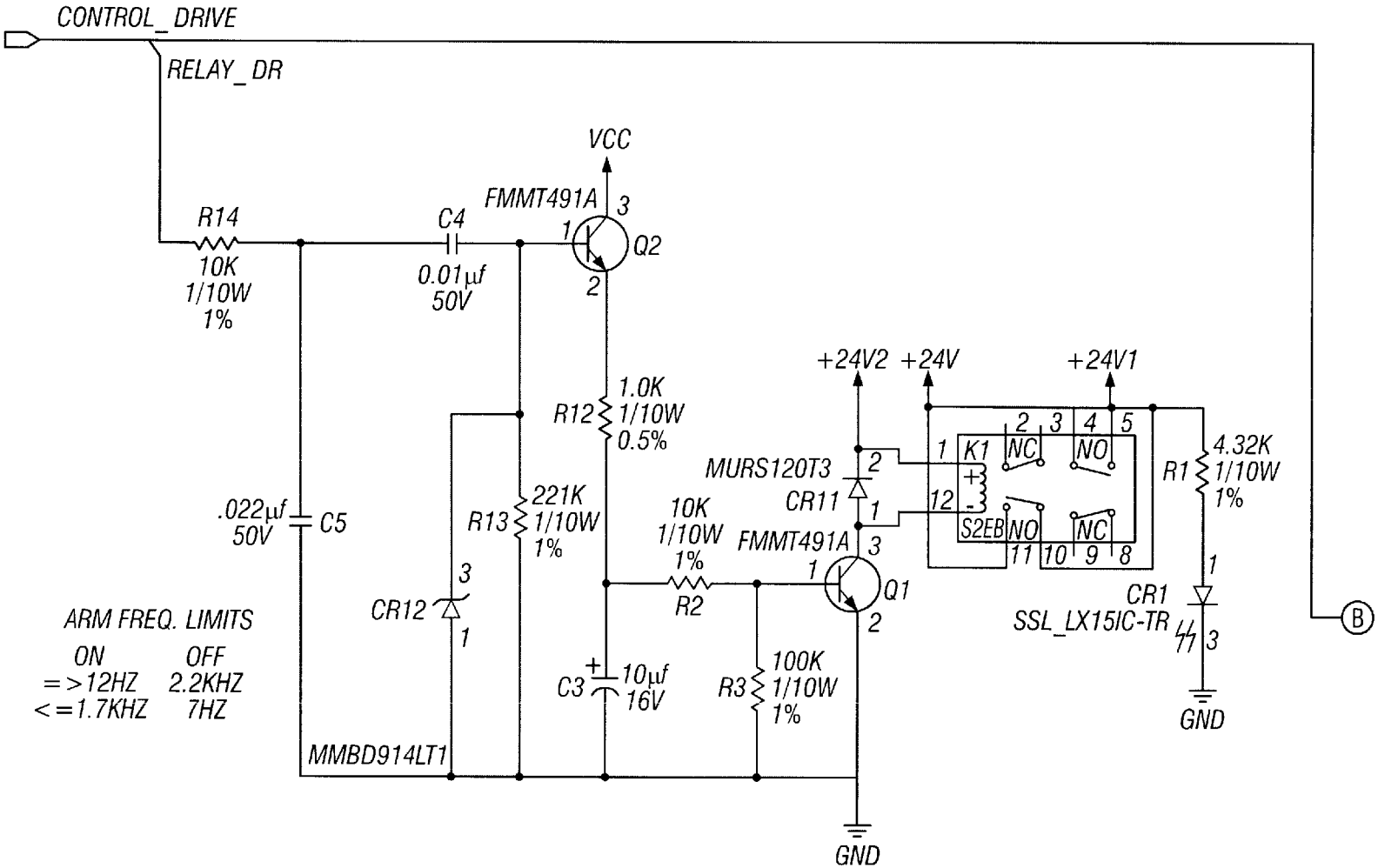
Figures 4, 19B:
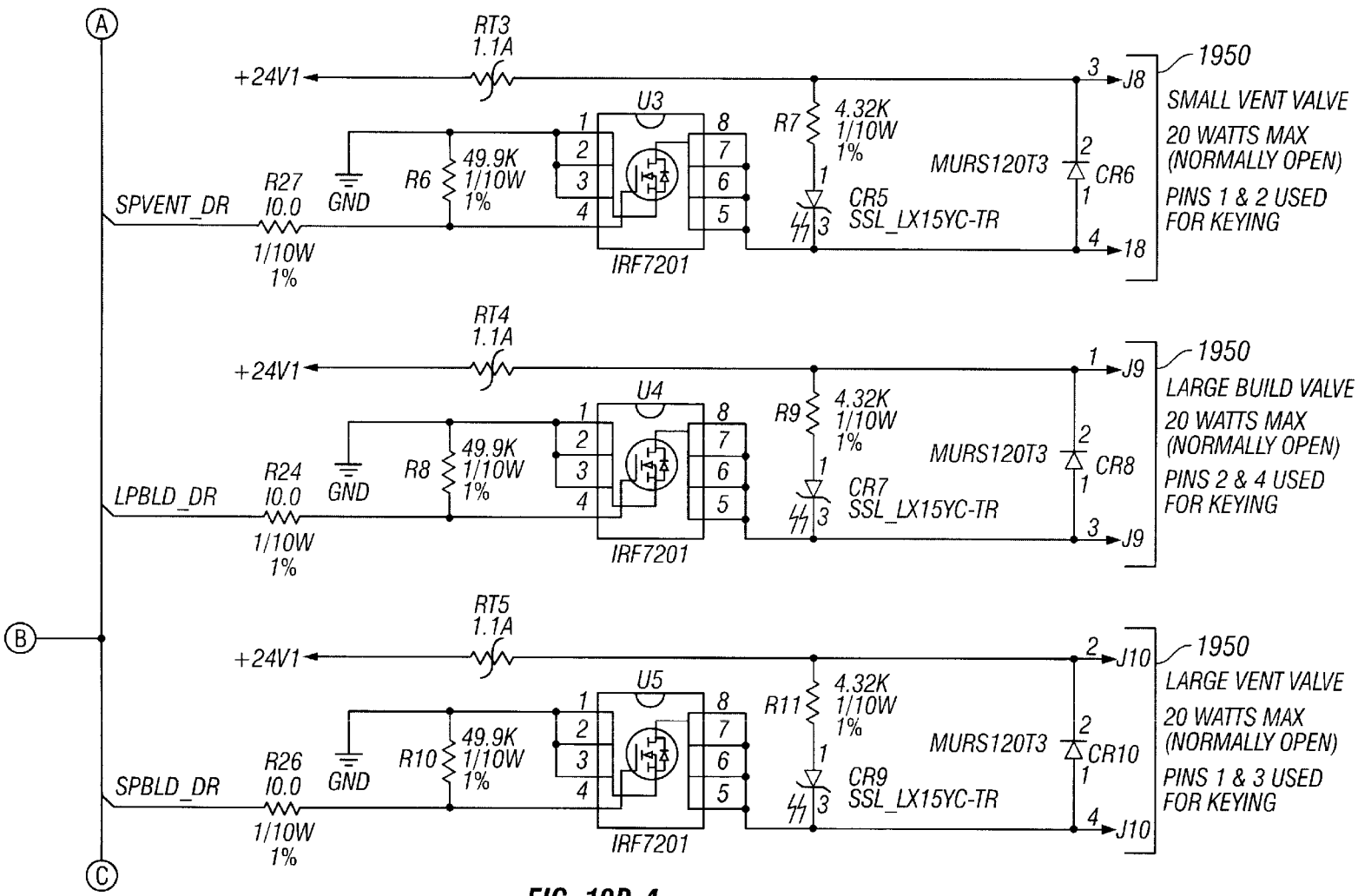
Figures 5, 19B:
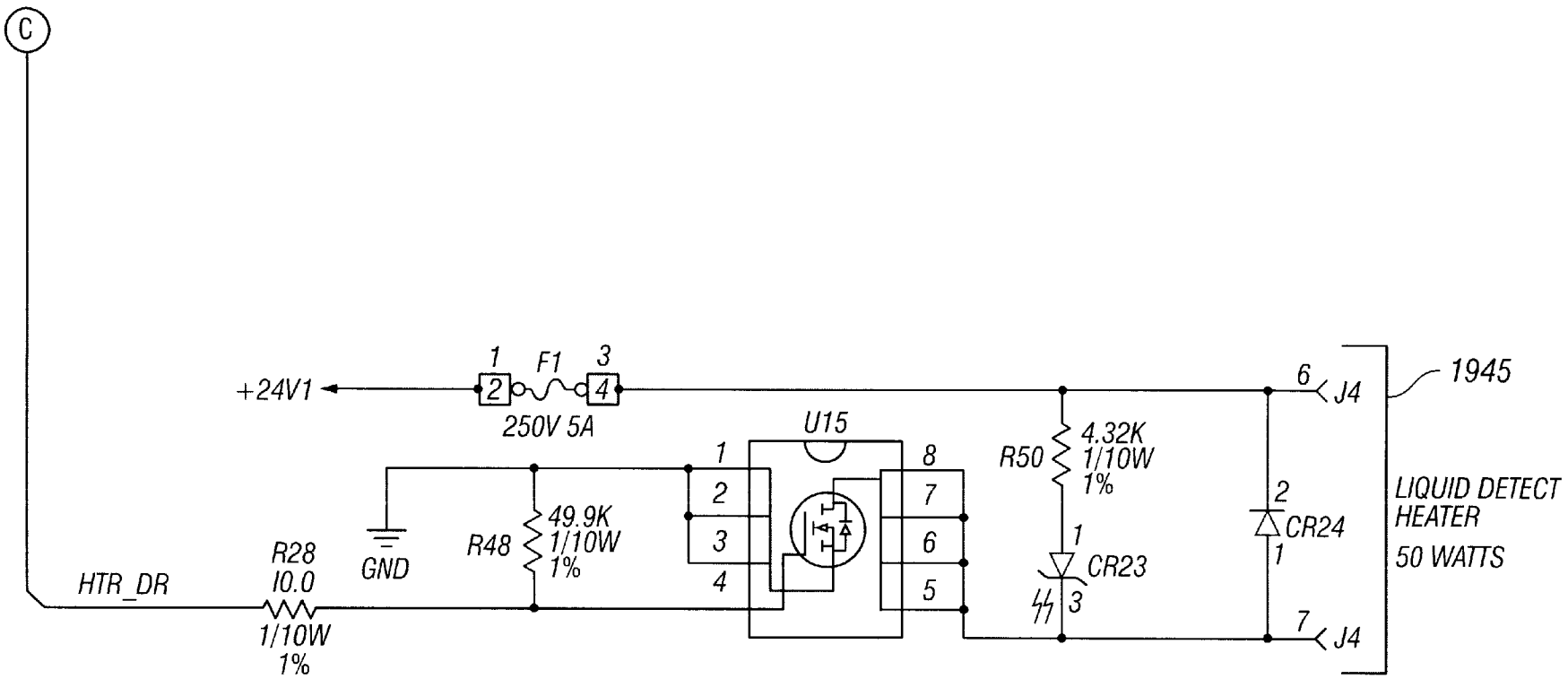

FIG. 19 illustrates the integration of supply reservoir 1610 with control electronics module 1920. Control electronics module 1920 comprises the control circuitry for controlling operations of supply reservoir 1610 based on information received from the liquid detector/evaporator assembly 150 and the DSC cell. According to one embodiment, control electronics module 1920 may perform the following operations: control of the pressure control device (see, e.g., pressure control valves 1620 of FIG. 16); monitoring of the liquid detector (see, e.g., the liquid detector/evaporator assembly 150 of FIG. 4); monitoring of the level of liquid in supply reservoir 1610; filling supply reservoir 1610 and exchange of status information with the DSC instrumentation.

Focusing on the liquid detection and feedback control features of the invention, control electronics module 1920 receives an indication of liquid in the exhaust through a feedback return from liquid detector/evaporator assembly 150. In the embodiment where the liquid detector is a thermocouple (see element 460 of FIG. 9), the feedback loop may comprise the return of leads 420 and 422 (FIG. 9) to control electronics module 1920. When exposed to liquid nitrogen, thermocouple bead 415 will experience a sudden temperature drop that will, in turn, be reflected by a voltage excursion at leads 420 and 422. This voltage excursion can be detected by control electronics module 1920 as an indication of the presence of liquid in the exhaust. Control electronics module 1920 then adjusts pressure control valves 1620 to reduce the amount of cooling agent supplied thereafter.

According to one embodiment, pressure control valves 1620 are controlled to provide cooling agent at a nominal higher pressure (e.g., between about 2 and 10 pounds per square inch) depending on the load imposed by the temperature profile programmed into the DSC instrumentation. When liquid is detected, pressure control valves 1620 are controlled to reduce this pressure to a nominal lower pressure (e.g., between about 1 and 8 pounds per square inch), again depending on the load.

After liquid has been detected and pressure has been reduced at supply reservoir 1610, the transition from the nominal lower pressure back to the nominal higher pressure can be addressed in several ways. According to one embodiment, control electronics module 1920 may monitor the feedback from liquid detector 460 to determine when thermal bead 415 is detecting a temperature in excess of a threshold (also referred to as the "detection temperature") such as one set in the range between about −110° to −170°. For a nitrogen cooling agent at these pressures, once temperature has increased to that range it can be concluded that liquid nitrogen is no longer present in the exhaust. According to another embodiment (which may permit a more rapid return to high pressure operation), control electronics module 1920 monitors feedback from liquid detector 460 to determine when a temperature rate increase has been achieved. For example, when a positive temperature rate slope of +3° C./second is measured, it can be concluded that liquid nitrogen is no longer present in the exhaust. Generally, the temperature rate increase could be selected from a range of about 1°–10° C./second, preferably about +3° C./second. According to yet another embodiment, a combination of absolute temperature and temperature rate thresholds may be employed.

Where liquid detector 460 (FIG. 9) comprises a detector other than a thermocouple (such as an RTD detector, an optical detector, a capacitive detector or a pressure detector), selection of appropriate criteria for concluding that liquid is no longer is present is well within the skill of the ordinary artisan. For example, if an RTD detector is used, an absolute temperature threshold and/or temperature rate increase threshold may be employed, as discussed above for the thermocouple liquid detector. If a pressure detector is employed, a threshold based on absolute pressure or pressure rate of change may be employed. Analogous thresholds may be employed for capacitive detectors and optical detectors.

The specific design of the circuitry of control electronics module 1920 is well within the skill of the ordinary artisan. Accordingly, the schematics of FIGS. 19A-1, 19A-2, 19A-3, 19A-4, 19A-5, 19A-6, 19B-1, 19B-2, 19B-3, 19B-4, and 19B-5 are to be considered exemplary only. At 1910 of FIGS. 19A-1, 19A-2, 19A-3, 19A-4, 19A-5, and 19A-6, the positive and negative leads of liquid detector 460 (see, e.g., lead 420 and lead 422 of FIG. 9) are input to control electronics module 1920 as part of the liquid detection feedback loop. At 1900 of FIGS. 19A-1, 19A-2, 19A-3, 19A-4, 19A-5, and 19A-6, the positive and negative leads of thermocouple element 450 (see FIG. 6) are input to control electronics module 1920. As previously mentioned according to one embodiment, thermocouple element 450 is monitored so that collector vessel 600 (FIG. 6) can be maintained at the nominal temperature operating point (e.g., about 40° C.) by adjusting the power supplied to heating element 452. Finally regarding FIGS. 19A-1, 19A-2, 19A-3, 19A-4, 19A-5, and 19A-6, at 1940 it is indicated that the maximum pressure output is about 10 pounds per square inch in this embodiment. Turning to the remainder of this exemplary design for control electronics module 1920, FIGS. 19B-1, 19B-2, 19B-3, 19B-4, and 19B-5 include liquid detect heater circuit 1945 for supplying power to heating element 452. FIGS. 19B-1, 19B-2, 19B-3, 19B-4, and 19B-5 also include control circuitry elements 1950 for controlling a pressure control device such as pressure control valves 1620 (FIG. 16).

Figure 20:
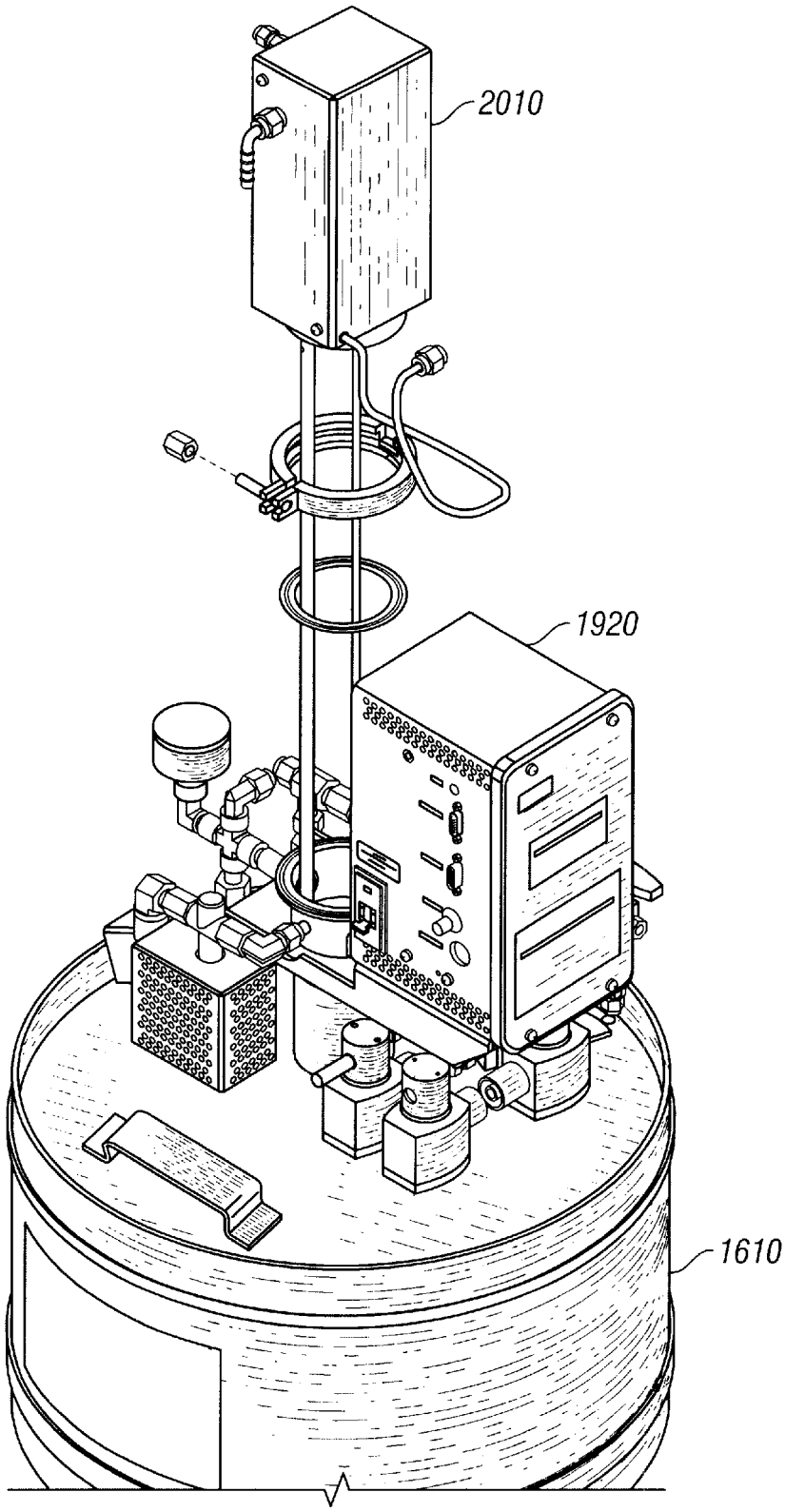
FIG. 20 provides a tilted top view of a supply reservoir integrated with the control electronics module and liquid delivery assembly according to one embodiment of the invention.

FIG. 20 illustrates the integration of supply reservoir 1610 and control electronics module 1920 with liquid delivery assembly 2010. Liquid delivery assembly 2010 routes liquid cooling agent from supply reservoir 1610 to the inlet tube 100 and on to heat exchanger 160. Liquid delivery assembly 2010 also receives vaporized exhaust from exhaust tube 105B so that it can be vented to atmosphere.

Figure 21:
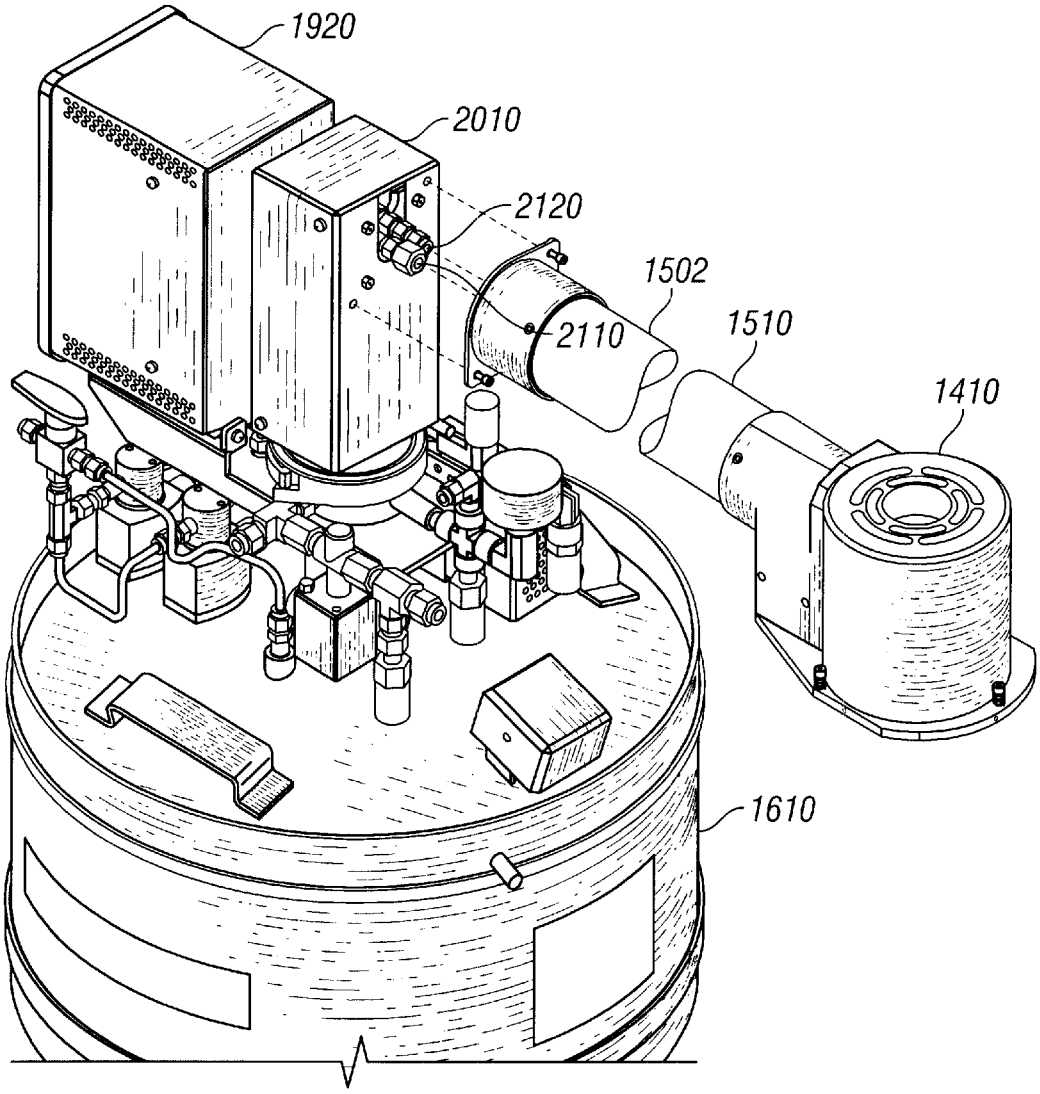
FIG. 21 illustrates the integration of the supply reservoir, control electronics module, and liquid delivery assembly of the liquid nitrogen cooling system according to one embodiment of the invention.

FIG. 21 illustrates the integration of the entire liquid nitrogen cooling system. The termination cap 1502 attaches to liquid delivery assembly 2010. The inlet tube 100 (hidden by routing tube member 1510) is attached to connector 2120 so that liquid cooling agent can be supplied from supply reservoir 1610 to the assembled heat exchanger 1410. The exhaust tube 105B (also hidden by routing tube member 1510) is attached to connector 2110 so that vaporized exhaust from the heat exchange can be vented to atmosphere.

Having described the construction of a novel liquid nitrogen cooling system with liquid detection and feedback control, a method for controlling operations of a change of phase liquid-gas heat exchanger cooling system is now described. In order to illustrate the method, reference will be made to components from the preceding figures. However, the explanation of the method using physical structure from preceding figures should be considered illustrative and exemplary only. The method described could easily be practiced using alternative system components. Just by way of example, detection of liquid in the exhaust could be accomplished using a component such as liquid detector/evaporator 150 (FIG. 1A) or an alternative component for liquid detection. In such an alternative arrangement, liquid detection could be accomplished using a resistance temperature detector separately located from a vessel for collecting and evaporating liquid droplets.

Figure 22:
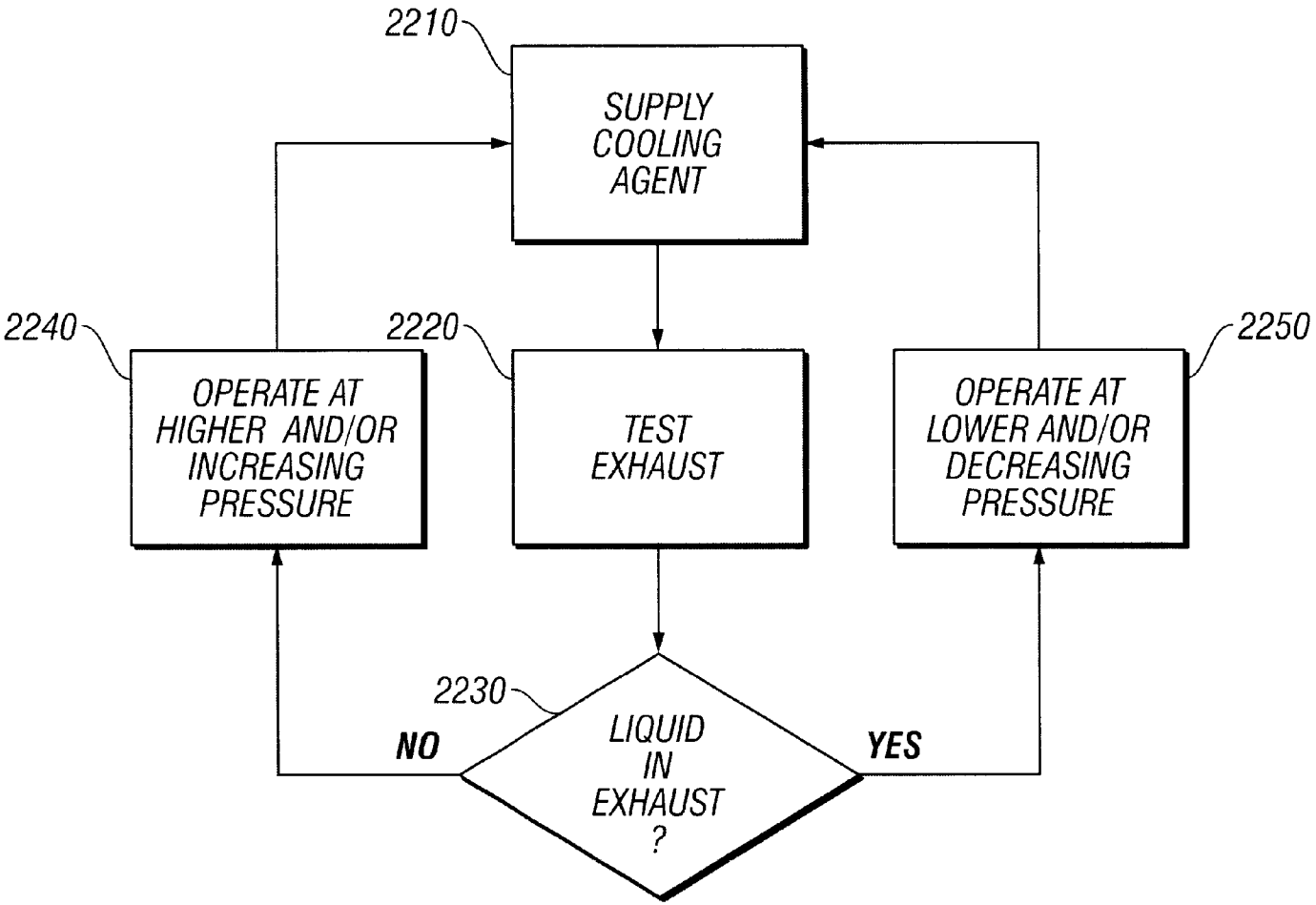
FIG. 22 illustrates a method according to an embodiment of the invention for controlling the delivery of cooling agent to a liquid-gas heat exchanger.

FIG. 22 provides an overview of a method for controlling the delivery of cooling agent to a liquid-gas heat exchanger. In FIG. 22, according to step 2210 cooling agent is supplied in order to cool a DSC cell. Referring back to FIG. 21, a cooling agent such as liquid nitrogen could be supplied from a supply reservoir 1610 to assembled heat exchanger 1410.

According to step 2220, the exhaust from the change of phase liquid-gas cooling process can be tested. Referring back to FIG. 9, such a test could be carried out by liquid detector 460, such as a thermocouple with thermocouple bead 415 contacting the exhaust.

According to decision block 2230, it is determined whether liquid is present in the exhaust. According to an embodiment, this could be accomplished by comparing a temperature to a temperature detection threshold or by comparing a temperature to a temperature rate of change threshold, as previously discussed. Other techniques for liquid detection, such as those previously discussed, could be employed.

If liquid is not present in the exhaust ("N" side of decision block 2230), the amount of cooling agent supplied is adjusted by operating at a higher pressure and/or by operating at an increasing pressure, as indicated in block 2240.

If liquid is present in the exhaust ("Y" side of decision block 2230), the amount of cooling agent supplied is adjusted by operating at a lower pressure and/or by operating at a decreasing pressure, as indicated in block 2250.

Just by way of example, the above steps (2240 and 2250) could be carried out by a control electronics module 1920 (FIG. 21) regulating operation of a pressure control device such as pressure control valves 1620 (FIG. 16).

After the pressure is adjusted by block 2240 (higher pressure) or by block 2250 (lower pressure), the procedure returns to step 2210. Subsequent cycles continue to control the pressure in the manner to keep the heat exchanger full of liquid nitrogen.

The operation steps of blocks 2240/2250 (e.g., for block 2240 operating at a higher pressure and/or at an increasing pressure) means that the pressure change can be implemented in several ways. According to one embodiment, the pressure is shifted in predetermined incremental values or steps. A step could comprise 2 psi, for example. Other step values could be employed. According to this embodiment, block 2240 provides for the pressure to be increased by the step value. For example, if the current pressure is 10 psi and liquid is not present in the exhaust, the pressure will be increased by the step value to a higher pressure. If the step value is 2 psi, the pressure increases to 12 psi. The pressure will continue to increase in increments of the step value (there may be a maximum allowable pressure, of course) until liquid is detected. When liquid is detected, the pressure is decreased by the step value. Accordingly, if the pressure is at 14 psi and liquid is detected, the pressure is decreased by the step value, e.g., to 12 psi. The pressure may continue to be decreased by the step value until liquid is no longer detected, and so on.

According to another embodiment, the amount of coolant supplied is adjusted by changing the pressure at a pressure rate of change, i.e., a pressure rate of increase or a pressure rate of decrease. For example, if liquid is not detected, the pressure may be increased at a 1 psi/minute rate. If liquid is detected, the pressure may be decreased at a 1 psi/minute rate. The 1 psi/minute rate is exemplary, and other rates of pressure increase or decrease could be used.

According to yet another embodiment, a combination of a step and a pressure rate of change can be used. For example, when the state changes from liquid-present to liquid-not-present, the pressure may be initially increased by the step value. Thereafter the pressure is subjected to a pressure rate of increase if the liquid-not-present state continues. In like fashion, if the state changes from liquid-not-present to liquid-present, the pressure is initially decreased by the step value. The pressure is then decreased according to a pressure rate of decrease if the liquid-present state persists.

As an example of the above embodiment, assume that the step value is 2 psi, the pressure rate of increase value is 1 psi/minute, the current pressure is 8 psi, and that the last test indicated that liquid was present. If the current test indicates that liquid is not present, the pressure increases to 10 psi. If the next test indicates that liquid is still not present, the pressure increases from 10 psi at a 1 psi/minute rate. A variation of this embodiment provides that the pressure rate of change is applied immediately rather than waiting for the next test. For the above example, when the state changes from liquid-present to liquid-not-present, the pressure would jump to 10 psi and increase at a 1 psi/minute rate. The 1 psi/minute rate would continue until as long as the state remains as liquid-not-present.

It should be appreciated that the numerical values for step values, pressure rate of increase, and pressure rate of decrease, provided above are for illustration purposes only. Additionally, it should be appreciated that the values may differ for the liquid-present and liquid-not-present states. For example, a step value of 2 psi may be used for the liquid-present state, whereas a step value of 1 psi may be used for the liquid-not-present state.

Having described methods and apparatus for an improved change of phase liquid-gas heat exchanger, it should be apparent to the artisan of ordinary skill that numerous advantages flow from the invention described herein. The liquid detection feature of the invention permits a feedback control capability for providing an amount of liquid nitrogen that maximizes cooling while minimizing liquid in the exhaust. The evaporator feature of the liquid detector/evaporator provides ensures that residual liquid in the exhaust is vaporized before passing further. This prevents frost, leakage, overflow and other problems. In sum, the present invention permits liquid-gas heat exchange in a most efficient manner while minimizing the problems which can arise from using liquid cooling agents.

Embodiments of systems and methods have been described. In the foregoing description, for purposes of explanation, numerous specific details are set forth to provide a thorough understanding of the present invention. It will be appreciated, however, by one skilled in the art that the present invention may be practiced without these specific details. Additionally, in the foregoing detailed description, the present invention has been described with reference to specific exemplary embodiments. These specific embodiments are intended to be exemplary only and, accordingly, the present specification and figures are to be regarded as illustrative rather than restrictive.

What is claimed is:

1. A liquid-gas cooling system, comprising:

a heat exchanger;

a liquid detector receiving an exhaust from the heat exchanger and detecting liquid in the exhaust; and a feedback loop for passing an indication as to whether liquid is present in the exhaust to a controller;

whereby the controller adjusts the amount of cooling agent supplied to the heat exchanger based on said indication.

2. The liquid-gas cooling system of claim 1, further comprising a collector for receiving and vaporizing at least some of the liquid present in the exhaust.

3. The liquid-gas cooling system of claim 2, wherein the collector comprises a first heating means thermally coupled to a vessel.

4. The liquid-gas cooling system of claim 3, wherein the first heating means is a heater strip.

5. The liquid-gas cooling system of claim 4, wherein the heater strip includes a thermocouple element for monitoring temperature, and wherein the controller adjusts the level of power supplied to the heater strip based on the monitored temperature.

6. The liquid-gas cooling system of claim 3, wherein the first heating means maintains the collector at a temperature of about 40° C.

7. The liquid-gas cooling system of claim 3, wherein the first heating means is thermally coupled to the liquid detector.

8. The liquid-gas cooling system of claim 3, wherein the thermal coupling of the first heating means to the liquid detector provides for the liquid detector to be at a temperature sufficiently high as to permit liquid detection.

9. The liquid-gas cooling system of claim 3, wherein a second heating means is thermally coupled to the liquid detector.

10. The liquid-gas cooling system of claim 9, wherein the thermal coupling of the second heating means to the liquid detector provides for the liquid detector to be at a temperature sufficiently high as to permit liquid detection.

11. The liquid-gas cooling system of claim 1, wherein the controller changes the pressure at a supply reservoir in response to said indication.

12. The liquid-gas cooling system of claim 1, wherein the controller provides for a first pressure at a supply reservoir when liquid is not detected and provides for a second pressure at the supply reservoir when liquid is detected.

13. The liquid-gas cooling system of claim 12, wherein the first pressure is greater than the second pressure, and wherein the first pressure can be found in a first range of about 2 through 10 pounds per square inch and wherein the second pressure can be found in a second range of about 1 through 8 pounds per square inch.

14. The liquid-gas cooling system of claim 12, wherein the difference between the first pressure and the second pressure corresponds to a predetermined incremental value of pressure.

15. The liquid-gas cooling system of claim 12, wherein the difference between the first pressure and the second pressure corresponds to a predetermined pressure rate of increase or decrease.

16. The liquid-gas cooling system of claim 12, wherein the controller changes from the second pressure to the first pressure upon detection of a temperature above about −110 to −170° C. in the exhaust.

17. The liquid-gas cooling system of claim 12, wherein the controller changes from the second pressure to the first pressure upon detection of a temperature rate increase of about 3° C. per second.

18. The liquid-gas cooling system of claim 1, wherein the liquid detector comprises a thermocouple exposed to liquid in the exhaust.

19. The liquid-gas cooling system of claim 18, wherein the thermocouple is a 14 gauge type T thermocouple with one of the thermoelements being copper.

20. The liquid-gas cooling system of claim 1, wherein the liquid detector comprises a resistance temperature detector (RTD) exposed to liquid in the exhaust.

21. The liquid-gas cooling system of claim 1, wherein the liquid detector comprises an optical detector exposed to the exhaust.

22. The liquid-gas cooling system of claim 1, wherein the liquid detector comprises a capacitive detector exposed to the exhaust.

23. The liquid-gas cooling system of claim 1, wherein the liquid detector comprises a pressure detector exposed to the exhaust.

24. The liquid-gas cooling system of claim 18 or claim 20, wherein the electrical leads of the liquid detector connect to the feedback loop.

25. A method of controlling a liquid-gas cooling system, comprising:

supplying a cooling agent from a supply reservoir to a heat exchanger;

determining if liquid is present in an exhaust from the heat exchanger;

adjusting the amount of cooling agent supplied to the heat exchanger in response based on the step of determining.

26. The method of claim 25, further comprising the step of collecting and vaporizing at least some of the liquid present in the exhaust.

27. The method of claim 25, wherein the step of adjusting comprises increasing or decreasing the pressure at the supply reservoir.

28. The method of claim 25, wherein it is determined that liquid is present in the exhaust, and wherein the step of adjusting comprises the controller changing the pressure at the supply reservoir from a first pressure to a second pressure, the first pressure being greater than the second pressure.

29. The method of claim 28, wherein the first pressure is found in a first range in between about 2 and 10 pounds per square inch and the second pressure is found in a second range in between about 1 and 8 pounds per square inch.

30. The method of claim 25, wherein it is determined that liquid is not present in the exhaust, and wherein the step of adjusting comprises the controller changing the pressure at the supply reservoir from a second pressure to a first pressure, the second pressure being less than the first pressure.

31. The method of claim 28 or claim 30, wherein the difference between the first pressure and the second pressure corresponds to a predetermined incremental value of pressure.

32. The method of claim 28 or claim 30, wherein the difference between the first pressure and the second pressure corresponds to a predetermined pressure rate of decrease or increase.

33. The method of claim 30, wherein the determination is based on detection of a temperature in excess of about −110 to −170° C.

34. The method of claim 30, wherein the determination is based on detection of a temperature rate increase in excess of a rate from the range of about 1° C. per second to 10° C. per second.

35. The method of claim 25, wherein the step of determining is carried out using a thermocouple exposed to liquid in the exhaust.

36. The method of claim 25, wherein the step of determining is carried out using a resistance temperature detector exposed to liquid in the exhaust.

37. The method of claim 25, wherein the step of determining is carried out using an optical detector exposed to the exhaust.

38. The method of claim 25, wherein the step of determining is carried out using a capacitive detector exposed to the exhaust.

39. The method of claim 25, wherein the step of determining is carried out using a pressure detector exposed to the exhaust.

40. The method of claim 26, wherein the step of collecting and vaporizing is carried out using a heated collector.

41. The method of claim 40, wherein the step of determining is carried out using a liquid detector exposed to liquid in the exhaust, and wherein the heated collector is thermally coupled to the liquid detector so as to maintain the liquid detector at a temperature above ambient when liquid is not present in the exhaust.

42. The method of claim 25, wherein the step of determining is carried out using a liquid detector exposed to liquid in the exhaust, and wherein the liquid detector is thermally coupled to a heating means so as to maintain the liquid detector above a detection temperature when liquid is not present in the exhaust.

43. An assembly for detecting and evaporating liquid found in an exhaust of a liquid-gas heat exchanger, comprising:

a generally cylindrical vessel for collecting the liquid, said vessel having an upper open end, a lower closed end, and a lateral side;

a heater strip disposed around the lateral side of the generally cylindrical vessel for heating the liquid collected therein; and a liquid detector located adjacent to the upper open end of the vessel for detecting the presence of liquid in the exhaust.

44. The assembly of claim 43, wherein the liquid detector is a thermocouple.

45. The assembly of claim 43, wherein the liquid detector is a resistance temperature detector.

46. The assembly of claim 43, wherein the liquid detector is an optical detector.

47. The assembly of claim 43, wherein the liquid detector is a capacitive detector.

48. The assembly of claim 43, wherein the liquid detector is a pressure detector.

49. The assembly of claim 43, wherein the heater strip includes a thermocouple element for monitoring temperature of the heater strip.

50. The assembly of claim 44 or claim 45, wherein the heater strip is thermally coupled to the liquid detector so as to maintain the liquid detector at a temperature above a detection temperature when liquid is not present.

51. The assembly of claim 44 or claim 45, wherein a heating means separate from the heater strip is thermally coupled to the liquid detector so as to maintain the liquid detector at a temperature above a detection temperature when liquid is not present.

52. The assembly of claim 44, further comprising a generally cylindrical first sleeve member having a first outer diameter and a first inner diameter, the first inner diameter being sufficiently large for the first sleeve member to be concentrically located around the upper open end of the vessel.

53. The assembly of claim 52, wherein the first sleeve member includes a first aperture for receiving the leads of the thermocouple.

54. The assembly of claim 53, further comprising a generally cylindrical second sleeve member having a second outer diameter and a second inner diameter, the second outer diameter being sufficiently small for the second sleeve member to be concentrically located within the first inner diameter of the first sleeve member.

55. The assembly of claim 54, wherein the second sleeve member includes a top surface defined between the second outer diameter and second inner diameter, the top surface including a second aperture for receiving the leads of the thermocouple.

56. The assembly of claim 55, wherein the thermocouple bead of the thermocouple rests on the top surface adjacent to the second aperture.

57. A liquid-gas cooling system, comprising:

means for receiving a liquid cooling agent for cooling a DSC cell and for outputting an exhaust;

means for detecting the presence of liquid in the exhaust;

whereby the controller changes the amount of cooling agent supplied to the means for receiving a liquid cooling agent based on said indication.

58. The liquid-gas cooling system of claim 57, wherein the means for receiving comprises a heat exchanger.

59. The liquid-gas cooling system of claim 58, wherein the means for detecting comprises a thermocouple.

60. The liquid-gas cooling system of claim 58, wherein the means for detecting comprises an optical detector.

61. The liquid-gas cooling system of claim 58, wherein the means for detecting comprises a capacitive detector.

62. The liquid-gas cooling system of claim 58, wherein the means for detecting comprises a pressure detector.

63. The liquid-gas cooling system of claim 58, wherein the means for detecting comprises a resistance temperature detector.

64. The liquid-gas cooling system of claim 63, further comprising means for collecting and evaporating at least some of the liquid present in the exhaust.

65. The liquid-gas cooling system of claim 64, wherein said means for collecting and evaporating comprises a heated vessel.

66. The liquid-gas cooling system of claim 58, wherein the controller changes the amount of cooling agent supplied by controlling the pressure at a supply reservoir.

67. The liquid-gas cooling system of claim 66, wherein the pressure at the supply reservoir is decreased in response to the indication.

* * * * *